US012421949B2

(12) United States Patent
Jeong et al.

(10) Patent No.: US 12,421,949 B2
(45) Date of Patent: Sep. 23, 2025

(54) HERMETIC COMPRESSOR

(71) Applicant: LG ELECTRONICS INC., Seoul (KR)

(72) Inventors: Mingeon Jeong, Seoul (KR); Bokann Park, Seoul (KR); Kyoungjun Park, Seoul (KR); Seeun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 395 days.

(21) Appl. No.: 17/491,682

(22) Filed: Oct. 1, 2021

(65) Prior Publication Data

US 2022/0145872 A1 May 12, 2022

(30) Foreign Application Priority Data

Nov. 6, 2020 (KR) ..... 10-2020-0147954

(51) Int. Cl.
*F04B 39/02* (2006.01)
*F04B 35/04* (2006.01)
*F04B 39/00* (2006.01)

(52) U.S. Cl.
CPC ..... *F04B 39/0253* (2013.01); *F04B 35/04* (2013.01); *F04B 39/0094* (2013.01); *F04B 39/0261* (2013.01)

(58) Field of Classification Search
CPC .. F04B 35/04; F04B 39/0261; F04B 39/0094; F04B 39/0246–0253; F04B 39/0238–0253
See application file for complete search history.

(56) References Cited

U.S. PATENT DOCUMENTS 3,410,478 A * 11/1968 Geisenhaver ..... F04B 39/0246 417/415
3,692,435 A * 9/1972 Iida ..... F04B 39/0246 417/372
4,478,559 A * 10/1984 Andrione ..... F04B 39/0246 417/372

(Continued)

FOREIGN PATENT DOCUMENTS

CN 1186169 7/1998
CN 106438283 A * 2/2017 ..... F04B 39/0094

(Continued)

OTHER PUBLICATIONS

European Search Report issued in Application No. 21205531.3 dated Feb. 11, 2022.

(Continued)

*Primary Examiner* — Alexander B Comley
(74) *Attorney, Agent, or Firm* — KED & ASSOCIATES

(57) ABSTRACT

A hermetic compressor may include a frame, a crankshaft, and an oil pump. The crankshaft may be rotatably mounted to the frame. The oil pump may be mounted to a lower portion of the crankshaft to be rotatable together with the crankshaft. The oil pump may pump oil from a lower region to an upper region of a shell using centrifugal force. The crankshaft may be provided with a hollow hole therein that is inclined in two directions with respect to an axial direction of the crankshaft. This may result in increasing a dynamic pressure for scattering the oil to the upper region of the shell and an oil supply amount.

18 Claims, 28 Drawing Sheets

(56) References Cited

U.S. PATENT DOCUMENTS

| | | | | |
|---|---|---|---|---|
| 5,842,420 | A * | 12/1998 | Khoo | F16N 7/366 418/94 |
| 6,416,296 | B1 * | 7/2002 | Nunes, Jr. | F04B 39/0246 418/88 |
| 7,993,114 | B2 * | 8/2011 | Hayashi | F04B 39/0253 184/6.5 |
| 8,978,826 | B2 * | 3/2015 | Kim | F04B 39/0253 417/372 |
| 2004/0151604 | A1 * | 8/2004 | Ishida | F04B 39/0253 417/372 |
| 2005/0180871 | A1 * | 8/2005 | Ohtahara | F04C 18/0215 417/410.5 |
| 2005/0271532 | A1 * | 12/2005 | Chung | F04B 39/0253 417/372 |
| 2006/0269428 | A1 * | 11/2006 | Akashi | F04B 39/0253 417/415 |
| 2007/0025864 | A1 * | 2/2007 | Cho | F04B 39/0253 417/415 |
| 2011/0265510 | A1 * | 11/2011 | Kim | F04B 27/0404 417/437 |
| 2016/0177933 | A1 * | 6/2016 | Lee | F04B 39/122 417/374 |
| 2017/0114782 | A1 * | 4/2017 | Manke | F04B 39/123 |
| 2021/0062798 | A1 * | 3/2021 | Akashi | F04B 39/0094 |

FOREIGN PATENT DOCUMENTS

| | | | |
|---|---|---|---|
| CN | 106438283 | | 11/2018 |
| EP | 1 408 235 | | 4/2004 |
| JP | 2000087856 | A * | 3/2000 |
| JP | 2000145637 | A * | 5/2000 |
| JP | 2000-291551 | | 10/2000 |
| JP | 2000291551 | A * | 10/2000 |
| KR | 10-2001-0032078 | | 4/2001 |
| KR | 2002-0096530 | | 12/2002 |
| KR | 2017-0117953 | | 10/2017 |
| KR | 10-2020-0067558 | | 6/2020 |
| WO | WO 2006/001111 | | 1/2006 |

OTHER PUBLICATIONS

Korean Office Action issued in Application No. 10-2020-0147954 dated Mar. 18, 2022.

* cited by examiner

HERMETIC COMPRESSOR

CROSS-REFERENCE TO RELATED APPLICATION(S)

Pursuant to 35 U.S.C. § 119(a), this application claims the benefit of the earlier filing date and the right of priority to Korean Patent Applications No. 10-2020-0147954, filed in Korea on Nov. 6, 2020, the contents of which are incorporated by reference herein in its entirety.

BACKGROUND

1. Field

A hermetic compressor capable of feeding oil using a centrifugal pump is disclosed herein.

2. Background

A compressor is an apparatus that includes a motor unit, and a compression unit to compress refrigerant passing through an evaporator in a refrigeration or air-conditioning system, such as a refrigerator or an air conditioner, and to deliver the compressed refrigerant to a condenser. Compressors may be classified into an open type and a closed type according to a hermetic structure.

A hermetic compressor accommodates a motor unit and a compression unit in a single completely-enclosed housing (also called a "shell"). Compressors may be classified into a reciprocating type, a rotary type, a vane type, and a scroll type, for example, according to a method of compressing refrigerant.

A compression unit of a reciprocating compressor is provided with a piston that reciprocates inside of a cylinder block. The compression unit compresses refrigerant up to a preset or predetermined pressure by receiving a drive force through a connecting rod that converts a rotational motion of a crankshaft, which is press-fitted into a rotor to rotate together with the rotor, into a linear reciprocating motion.

A predetermined amount of oil is filled in a lower portion of a shell of a compressor. An oil pump is provided at a lower end portion of a crankshaft. The oil pump has a propeller that can rotate together with the crankshaft.

The oil pump is a type of centrifugal pump that pumps oil using centrifugal force. Oil pumped by the oil pump is scattered to each mechanical part inside of the shell through an oil passage formed in the crankshaft, thereby lubricating frictional motion parts of various mechanical parts and simultaneously cooling heat inside of the shell.

However, the related art oil pump is provided for a high-speed operation, and there is a problem that oil cannot be supplied smoothly during a low-speed operation. In other words, as the oil pump is a centrifugal pump that depends on centrifugal force, a height (head of fluid or head of oil, H) to which oil can be pumped may be calculated by the following equation.

$$H = \frac{(r\omega)^2}{2g}, \qquad \text{[Equation]}$$

where H denotes a head of fluid or head of oil, r denotes a radius, w denotes an angular velocity, and g denotes gravity acceleration.

As can be seen from the above equation, the head of fluid of the oil pump is proportional to the square of the angular velocity. When the compressor operates at a low speed, revolutions per minute (RPM) is reduced and thereby the angular velocity is decreased. This causes the head of the pump to be lowered. For this reason, if oil cannot be supplied properly due to the decrease in the head of the oil pump, lubrication performance to prevent wear of various mechanical parts is decreased and heat inside of the shell cannot be dissipated to outside, resulting in shortening a lifespan of the compressor.

Korean Laid-open Patent Publication No. 10-2001-0032078 (hereinafter, referred to as "Patent Document 1"), which is hereby incorporated by reference, discloses a reciprocating hermetic compressor. The hermetic compressor of Patent Document 1 includes an oil pump (centrifugal pump) provided on a lower portion of a vertical shaft to pump lubricating oil by centrifugal separation, and at least one axial flow path formed through an inside of the vertical shaft in a tubular shape in a radially outward direction such that oil can flow therealong. A lower end of the axial flow path is immersed in lubricating oil pumped from a lubricating oil sump formed at a bottom of the shell, and an upper end of the axial flow path communicates with a median radial duct.

Oil in the oil pump moves in an axial direction in a parabolic shape due to a rotational motion of the vertical shaft, and is discharged into the median radial duct. The axial flow path of Patent Document 1 increases an inner radius of the vertical shaft, so that lubricating performance can be enhanced even during a low-speed operation of the compressor. However, in Patent Document 1, rigidity of the vertical shaft is reduced due to a decreased thickness of the vertical shaft. This causes the vertical shaft to be deformed or broken upon being press-fitted into the rotor.

An inverter-type reciprocating compressor is required to operate at a low speed, in response to energy regulations of a refrigeration and air conditioning system. In addition, oil supply performance is very important for lubricating and securing reliability of mechanical parts.

U.S. Patent Publication No. US 2017/0114782 A1 (hereinafter, referred to as "Patent Document 2"), which is hereby incorporated by reference, discloses a reciprocating compressor having a lubricating oil pump. A rotational shaft in Patent Document 2 includes a lower region for pumping oil and an intermediate region for temporarily storing and transferring the oil.

A contouring recess is formed in a spiral shape in an inner wall of the lower region, and a retaining pin is fixedly inserted into the inner wall of the lower region. The contouring recess allows lubricating oil to be pumped using centrifugal force caused by relative motion between the rotational shaft and the retaining pin and viscous force of lubricating oil, thereby enhancing oil pumping performance.

However, in Patent Document 2 (viscous pump type), due to the spiral structure of the contouring recess provided in the lower region of the rotational shaft and the retaining pin structure accommodated in the rotational shaft, a number of parts increases, and the internal structure of the rotational shaft for oil pumping becomes complicated. In addition, Patent Document 2 has a problem in that a number of assembly processes increases and manufacturing costs increase because the retaining pin must be fixedly inserted into the lower region of the rotational shaft.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a hermetic compressor according to embodiments will be described with reference to the accompanying drawings. In the following description, a description of some components may be omitted to clarify features.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

A shell used in the description below may mean a housing of a compressor or a compressor main body.

Figure 1:
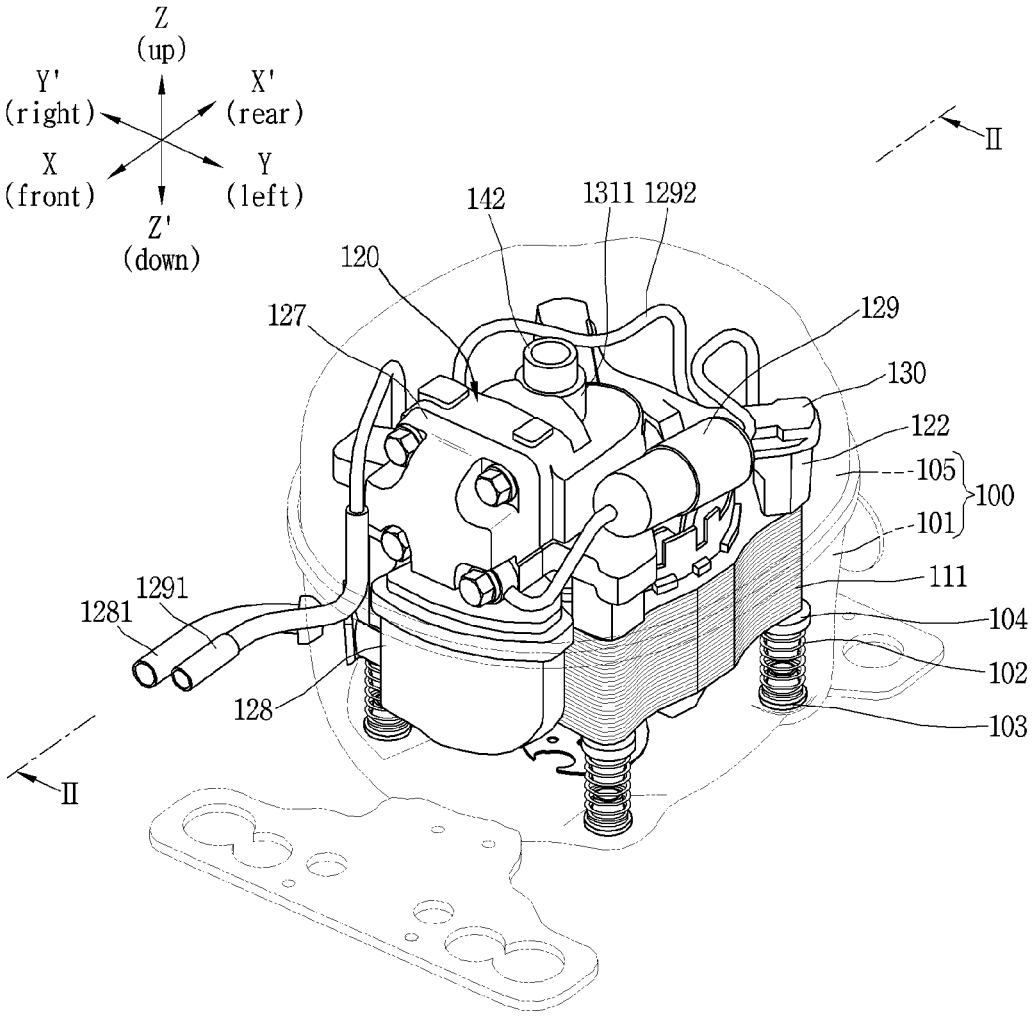
FIG. 1 is a schematic view illustrating a hermetic compressor in accordance with an embodiment.

The terms "front side", "rear side", "left side", "right side", "upper side", and "lower side" as used herein will be understood with reference to a coordinate system illustrated in FIG. 1. In particular, an upward direction may mean an opposite direction of gravity, and a downward direction may mean a direction of gravity.

The term "front" used in the following description may mean a direction in which a piston moves forward to a compression chamber of a cylinder for compressing refrigerant, and the term "rear" may mean a direction in which the piston moves backward from the compression chamber of the cylinder to suction refrigerant. An axial direction used in the following description may mean an upward-downward or vertical direction.

A compressor according to embodiments may be applied to a hermetic compressor or a reciprocating compressor, for example. The term "crankshaft" used in the following description refer to a shaft that converts rotational motion into linear motion, and refers mainly to a shaft used when moving a piston. The term "journal" used in the following description refers to a shaft part or component supported by a bearing, for example.

Figure 2:
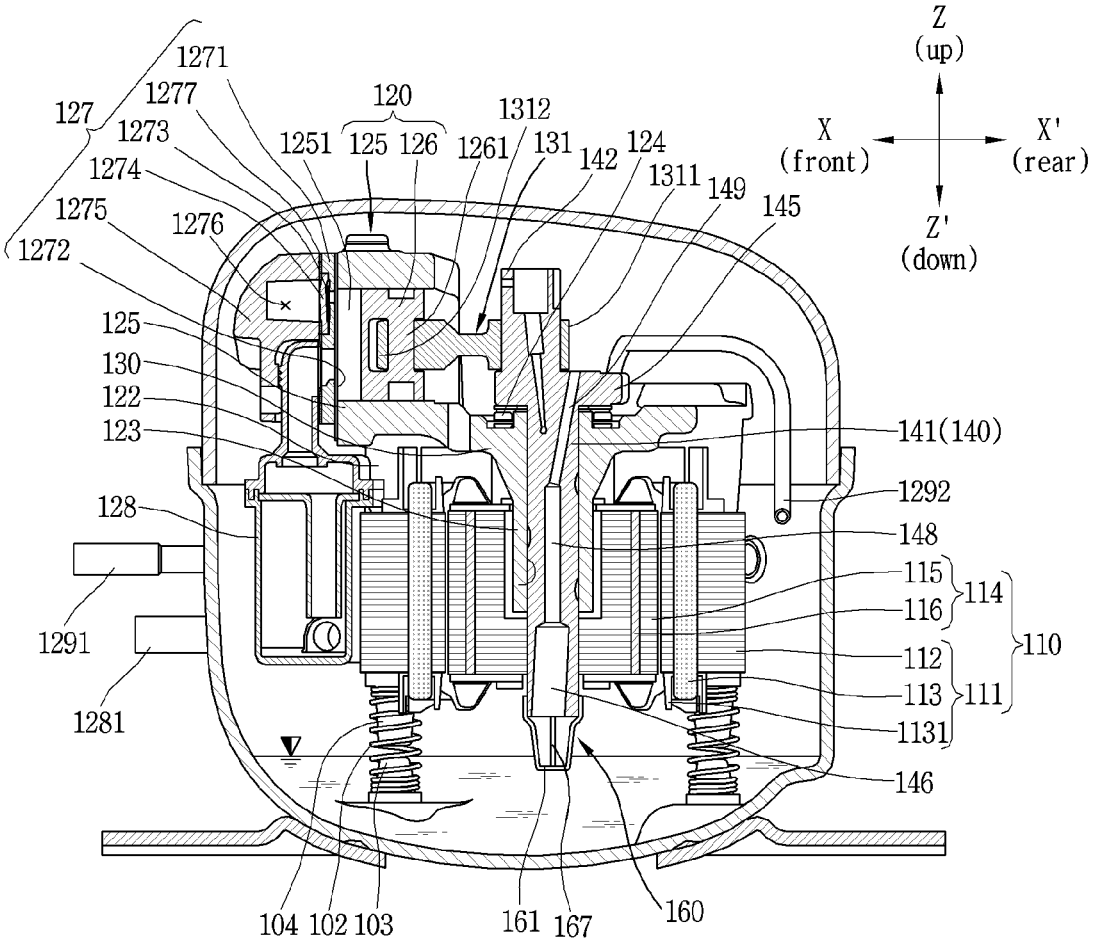
FIG. 2 is a cross-sectional view, taken along line II-II of FIG. 1.
Figure 3:
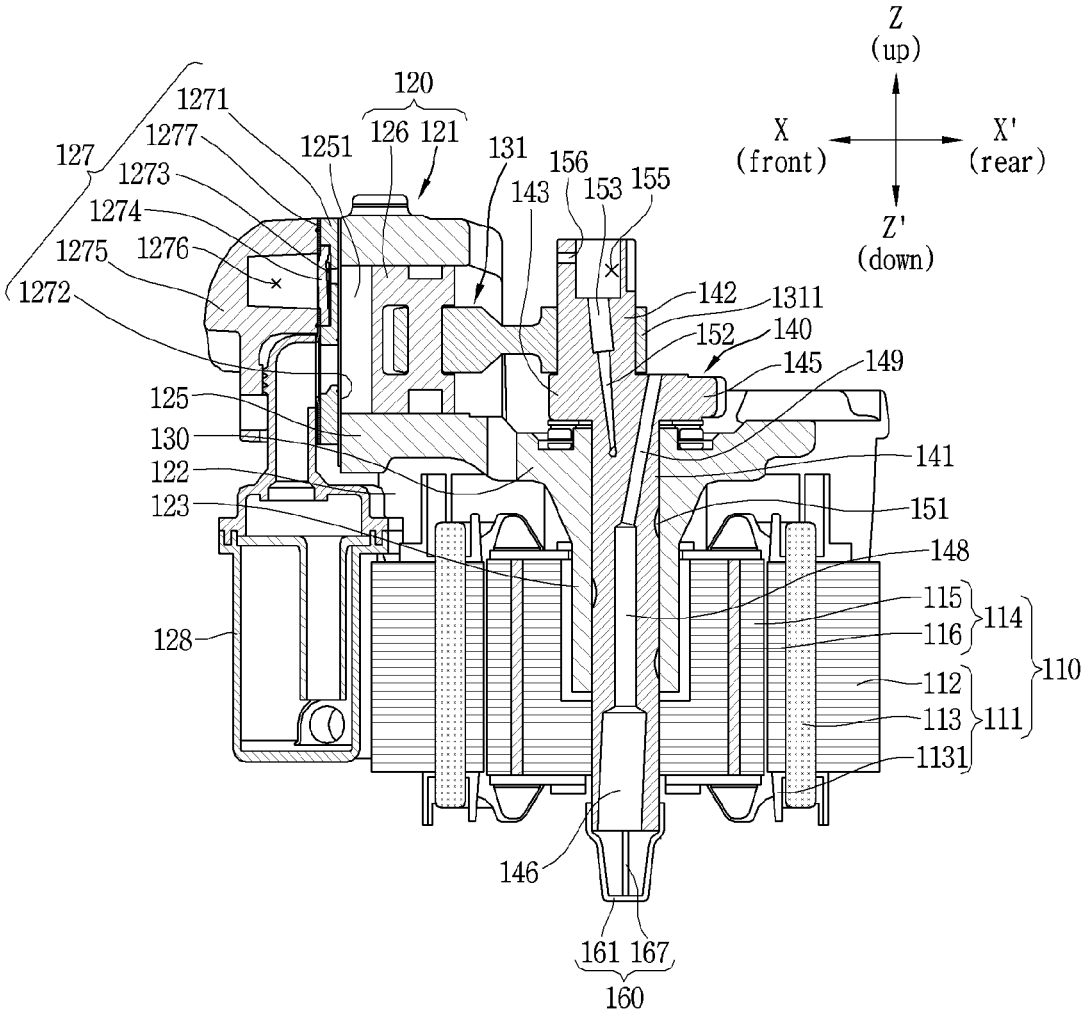
FIG. 3 is a cross-sectional view illustrating an arrangement structure of a motor unit and a compression unit after removing a shell of the compressor in FIG. 2.

FIG. 1 is a schematic view illustrating a hermetic compressor in accordance with an embodiment. FIG. 2 is a cross-sectional view, taken along line II-II of FIG. 1. FIG. 3 is a cross-sectional view illustrating an arrangement structure of a motor unit 110 and a compression unit 120 after removing a shell 100 of the compressor in FIG. 2.

Hereinafter, a compressor according to embodiments will be described with reference to the accompanying drawings.

A compressor according to an embodiment may include a shell 100, a motor unit 110, and a compression unit 120. The shell 100 may define an appearance of the compressor. The shell 100 may have an accommodation space therein. The accommodation space of the shell 100 may be sealed. The motor unit 110 and the compression unit 120 may be accommodated in the accommodation space of the shell 100.

The shell 100 may be made of an aluminum alloy (hereinafter, abbreviated as aluminum), for example. Aluminum has a light weight and a high thermal conductivity, which is advantageous in miniaturization and dissipation of heat inside the shell 100 to outside.

The shell 100 may include a base shell 101 and a cover shell 105. The base shell 101 may be formed in a semi-cylindrical or hemispherical shape, for example. The base shell 101 may be disposed under the cover shell 105. The base shell 101 may be open upward.

The cover shell 105 may be formed in a semi-cylindrical or hemispherical shape, for example. The cover shell 105 may be open downward. The cover shell 105 may be disposed to cover a top of the base shell 101. The base shell 101 and the cover shell 105 may define the accommodation space inside the shell 100.

An upper end portion or end of the base shell 101 may be coupled to surround an edge surface (circumferential surface) of a lower end portion or end of the cover shell 105. The base shell 101 and the cover shell 105 may be coupled to each other by, for example, welding or bolts.

The motor unit 110 may include a stator 111 and a rotor 114. The stator 111 may be accommodated in the accommodation space of the shell 100. The stator 111 may be elastically supported against a bottom surface of the base shell 101. The rotor 114 may be rotatably installed inside the stator 111.

The stator 111 may include a stator core 112 and a stator coil 113. The stator core 112 may be formed by stacking and bonding a plurality of electrical steel sheets. The stator core 112 may be formed in a rectangular shape, for example.

The stator coil 113 may be wound around the stator core 112 through slots formed on the stator core 112. When power is applied to the stator coil 113, a magnetic field may be generated around it.

A rotor accommodation hole may be formed in a cylindrical shape through an inside of the stator core 112 along an axial direction. The rotor 114 may be accommodated in the rotor accommodation hole, and may be rotatable with a gap from the stator 111.

The stator core 112 may be fixed to a lower surface of a cylinder block 121 by, for example, a coupling bolt.

The stator core 112 may be spaced apart from an inner surface of the shell 100 in the axial direction and a radial direction. In this case, a lower end of the stator core 112 may be supported on the bottom surface of the shell 100 by a support spring 102 described hereinafter. According to this embodiment, the support spring 102 may suppress vibration generated during operation of the compressor from being directly transferred to the shell 100.

An insulator 1131 may be disposed between the stator core 112 and the stator coil 113. The insulator 1131 may be electrically insulated by blocking contact between the stator core 112 and the stator coil 113.

The rotor 114 may include a rotor core 115 and permanent magnets 116. The rotor core 115 may be formed by stacking and bonding a plurality of electrical steel sheets. The stator core 115 may be formed in a cylindrical shape, for example.

A shaft coupling hole may be formed through a center of the rotor core 115 in the axial direction. A crankshaft 140 described hereinafter may be coupled through the shaft coupling hole of the rotor core 115.

The plurality of permanent magnets 116 may be inserted into the rotor core 115 in the axial direction. The plurality of permanent magnets 116 may be spaced apart from one another at a uniform interval along a circumferential direction of the rotor core 115. When an external voltage is applied to the stator coil 113, a magnetic field may be generated around the stator coil 113.

According to this embodiment, the stator 111 and the rotor 114 may interact electromagnetically with each other, so that the rotor 114 may rotate with respect to the stator 111. The motor unit 110 may generate a drive force for a reciprocating motion of the compression unit 120.

The crankshaft 140 may be configured to transmit the drive force of the motor unit 110 to the compression unit 120 described hereinafter while rotating together with the rotor 114.

An eccentric shaft 142 may be provided on an upper end portion of the crankshaft 140. A flange portion or flange 143 may be formed on a top of the crankshaft 140 to have a large diameter outward in the radial direction.

The eccentric shaft 142 may be eccentric from a center of the crankshaft 140 to a radially outer side of the flange portion 143. The eccentric shaft 142 may protrude upward from the flange portion 143.

An eccentric shaft coupling portion 1311 may be formed in a ring shape through one or a first end portion or end of a connecting rod 131. The eccentric shaft 142 may pass through the eccentric shaft coupling portion 1311 to be coupled to an inside of the eccentric shaft coupling portion 1311.

A piston coupling portion 1312 may be formed in another or a second end portion or end of the connecting rod 131. The piston coupling portion 1312 may be formed in a ring shape, for example. A connecting pin 1261 may be provided on the piston 126 described hereinafter toward the connecting rod 131. The piston coupling portion 1312 may be coupled to the coupling pin 1261.

According to this embodiment, the eccentric shaft 142 may rotate together with the crankshaft 140 in a state of being eccentric from the center of the crankshaft 140. The connecting rod 131 may convert a rotational motion of the eccentric shaft 142 into a reciprocating motion of the piston 126.

Accordingly, the crankshaft 140 may transmit rotational force of the motor unit 110 to the compression unit 120 through the connecting rod 131. The crankshaft 140 will be described hereinafter.

The compression unit 120 may include the cylinder block 121 and a piston 126. The cylinder block 121 may be provided at an upper side of the motor unit 110. The cylinder block 121 may be coupled to an upper portion of the stator 111 to be elastically supported by the shell 100.

The cylinder block 121 may include a frame 130, a stator coupling portion 122, a shaft support portion 123, and a cylinder 125. The frame 130 may extend in a horizontal direction intersecting with the axial direction. The frame 130 may be formed in a shape of a flat plate or formed by slimming a portion of an edge of the frame 130, for example.

The stator coupling portion 122 may protrude downward from the edge of the frame 130 toward the stator 111. The cylinder block 121 may be coupled to the stator 111 with a coupling bolt, for example. According to this embodiment, the cylinder block 121 may be elastically supported on the base shell 101 together with the stator 111.

The shaft support portion 123 may extend from a central portion of the frame 130 in the axial direction. A shaft accommodation hole may be formed through an inside of the shaft support portion 123 in the axial direction.

The crankshaft 140 may be rotatably mounted inside the frame 130 by being inserted through the shaft accommodation hole of the shaft support portion 123. A bush bearing may be inserted between an inner circumferential surface of the shaft support portion 123 and an outer circumferential surface of the crankshaft 140. The bush bearing may support the crankshaft 140 in the radial direction so that the crankshaft 140 is rotatable with respect to the frame 130.

A thrust bearing 124 may be provided on an upper end of the shaft support portion 123. The thrust bearing 124 may be disposed between the flange portion 143 of the crankshaft 140 and the upper end of the shaft support portion 123. The thrust bearing 124 may support an axial load of the crankshaft 140.

The shaft support portion 123 may be installed to be accommodated in a shaft support portion accommodating portion of the rotor core 115. The shaft support portion accommodating portion may be provided inside the rotor core 115. The shaft support portion accommodating portion may be formed in an upper end of the shaft accommodation hole of the rotor core 115 to have a larger diameter along the axial direction. A gap may be formed between an inner circumferential surface of the shaft support portion accommodating portion and an outer circumferential surface of the shaft support portion 123. The stator core 115 may be rotatable with respect to the shaft support portion 123.

The cylinder 125 may be provided on an edge of one side of the frame 130. The cylinder 125 may be disposed to be eccentric from a center of the frame 130 toward an outside in the radial direction.

A hollow portion in a cylindrical shape may be formed inside the cylinder 125. The hollow portion may be formed through the cylinder 125 in a lengthwise direction. The hollow portion may be formed through the shell 100 in a backward and forward (vertical) direction. The hollow portion may be formed through the center of the frame 130 in the radial direction.

The piston 126 may be accommodated in the cylinder 125. The piston 126 may have a structure in which a rear side thereof is open toward the connecting rod 131 and a front side opposite to the connecting rod 131 is closed.

The connecting pin 1261 may be provided on the rear side of the piston 126. The connecting pin 1261 may be coupled to the piston coupling portion 1312 of the connecting rod 131. The piston 126 may receive the drive force from the motor unit 110 through the connecting rod 131. The front side of the piston 126 may define a compression chamber 1251 inside the cylinder 125 together with a valve assembly 127 described hereinafter.

The piston 126 may be formed of the same material as the cylinder block 121, for example, aluminum. The piston 126 may suppress a magnetic flux transmitted from the rotor 114 to the piston 126 in terms of characteristics of aluminum. As the piston 126 is formed of the same material as the cylinder block 121, the piston 126 and the cylinder block 121 may have a same coefficient of thermal expansion.

This configuration may result in suppressing interference due to thermal expansion between the cylinder block 121 and the piston 126 even if the inner space of the shell 100 is in a high temperature state (approximately 100° C.) during operation of the compressor.

A suction and discharge part or portion may include the valve assembly 127, a suction muffler 128, and a discharge muffler 129. The valve assembly 127 and the suction muffler 128 may be sequentially coupled from an outer open end of the cylinder 125.

The valve assembly 127 according to this embodiment may include a valve plate 1271, a suction valve 1272, a discharge valve 1273, a valve stopper 1274, and a discharge cover 1275. The valve plate 1271 may be formed in a shape similar to a rectangular plate, for example. The valve plate 1271 may cover a front open surface of the compression chamber 1251. The valve plate 1271 may be coupled to the cylinder block 121.

The valve plate 1271 may be provided with one inlet port and a plurality of outlet ports. The inlet port may be formed in or at a central portion of the valve plate 1271, and the plurality of outlet ports may be formed at preset or predetermined intervals along a periphery of the inlet port.

The suction valve 1272 may be disposed on a rear side of the valve plate 1271 toward the piston 126. The suction valve 1272 may be formed of a thin steel plate, for example, compared to the valve plate 1271.

One or a first side of the suction valve 1272 may be supported by the valve plate 1271, and another or a second side of the suction valve 1272 may be a free end so as to be bent or elastically deformed toward the piston 126. The suction valve 1272 may open and close the inlet port.

The discharge valve 1273 may be disposed on a front side of the valve plate 1271 toward an opposite side of the piston 126. The discharge valve 1273 may be formed of a thin steel plate, for example, like the suction valve 1272.

One or a first side of the discharge valve 1273 may be supported by the valve plate 1271, and another or a second side of the discharge valve 1273 may be a free end so as to be bent or elastically deformed away from the piston 126. The discharge valve 1273 may individually open and close the plurality of outlet ports.

The discharge cover 1275 may be coupled to cover an outer open end of the cylinder block 121 with the suction valve 1272 and the valve plate 1271 interposed therebetween. The discharge cover 1275 may finally cover the compression chamber 1251. Accordingly, the discharge cover 1275 may be referred to as a "cylinder cover".

A muffler fixing portion may be formed in a central portion of the discharge cover 1275 to support a connection portion of the suction muffler 128 described hereinafter. A discharge chamber 1276 may be recessed around the muffler fixing portion with a partition wall therebetween.

The valve stopper 1274 may be provided inside the discharge chamber 1276. The valve stopper 1274 may be disposed between the discharge cover 1275 and the valve plate 1271. The valve stopper 1274 may press one side of the discharge valve 1273 to fix the one side of the discharge valve 1273.

The discharge chamber 1276 may be connected to the discharge muffler 129 described hereinafter through a loop pipe 1292.

A gasket 1277 may be further provided between the discharge cover 1275 and the valve plate 1271. The gasket 1277 may maintain airtightness between the discharge cover 1275 and the valve plate 1271.

The suction muffler 128 may transfer refrigerant suctioned through a suction pipe 1281 to the compression chamber 1251 of the cylinder 125. The suction muffler 128 may be fixed to the valve assembly 127. The suction muffler 128 may be connected to communicate with the inlet port of the valve plate 1271.

A suction space may be defined inside the suction muffler 128. An inlet of the suction space may be connected to communicate with the suction pipe 1281. An outlet of the suction space may be connected to communicate with a suction side of the valve assembly 127.

The discharge muffler 129 may be installed to be detachable from the cylinder block 121. A discharge space may be defined inside the discharge muffler 129. An inlet of the discharge space may be connected to communicate with a discharge side of the valve assembly 127 by the loop pipe 1292.

A support portion may support the motor unit 110 with respect to the bottom surface of the base shell 101. For example, a plurality of the support portion may be provided to support each corner portion of the motor unit 110 with respect to the base shell 101.

Each of the plurality of support portions may be provided as one set with a support spring 102, a first spring cap 103, and a second spring cap 104. The first spring cap 103 may be fixed to the bottom surface of the base shell 101, and a lower end portion or end of the support spring 102 may be supportedly coupled to the first spring cap 103. The second spring cap 104 may be fixed to a lower end of the motor unit 110, and an upper end portion or end of the support spring 102 may be supportedly coupled to the second spring cap 104.

The support spring 102 may elastically support a lower surface of the motor unit 110. In addition, the support spring 102 may elastically support the compression unit 120 coupled to an upper portion of the motor unit 110.

According to this embodiment, the reciprocating compressor may operate as follows.

When power is applied to the stator coil 113, a magnetic field may be formed around it. The stator 111 and the rotor 114 may electromagnetically interact with each other. The rotor 114 may rotate with respect to the stator 111.

Responsive to this, the crankshaft 140 coupled to the rotor 114 may rotate. Rotational force of the crankshaft 140 may be transferred to the piston 126 through the connecting rod 131.

The piston 126 may be reciprocated in a backward and forward direction within the cylinder 125 by the connecting rod 131. For example, when the piston 126 moves backward in the cylinder 125, a volume of the compression chamber 1251 may increase and pressure in the compression chamber 1251 may decrease. Refrigerant filled in the suction muffler 128 may be introduced into the compression chamber 1251 through the suction valve 1272 of the valve assembly 127.

On the other hand, when the piston 126 moves forward in the cylinder 125, the volume of the compression chamber 1251 may decrease and the pressure in the compression chamber 1251 may increase. The refrigerant filled in the compression chamber 1251 may be compressed, and discharged into the discharge chamber 1276 of the discharge cover 1275 through the discharge valve 1273.

The discharged refrigerant may flow into the discharge space of the discharge muffler 129 through the loop pipe 1292, and be discharged into a refrigeration cycle along the loop pipe 1292 and the discharge pipe 1291. This series of processes may be repeatedly performed.

The discharge valve 1273 may be opened and closed by a pressure difference between the compression chamber 1251 and the discharge chamber 1276. During a suction stroke of the piston 126, the pressure of the compression chamber 1251 may be lower than the pressure of the discharge chamber 1276 and the discharge valve 1273 may be pushed by the pressure of the discharge chamber 1276 so as to be kept closed. On the other hand, during a discharge stroke of the piston 126, the pressure of the compression chamber 1251 may be higher than the pressure of the discharge chamber 1276 and the discharge valve 1273 may be opened by being pushed by the pressure of the compression chamber 1251.

Figure 4:
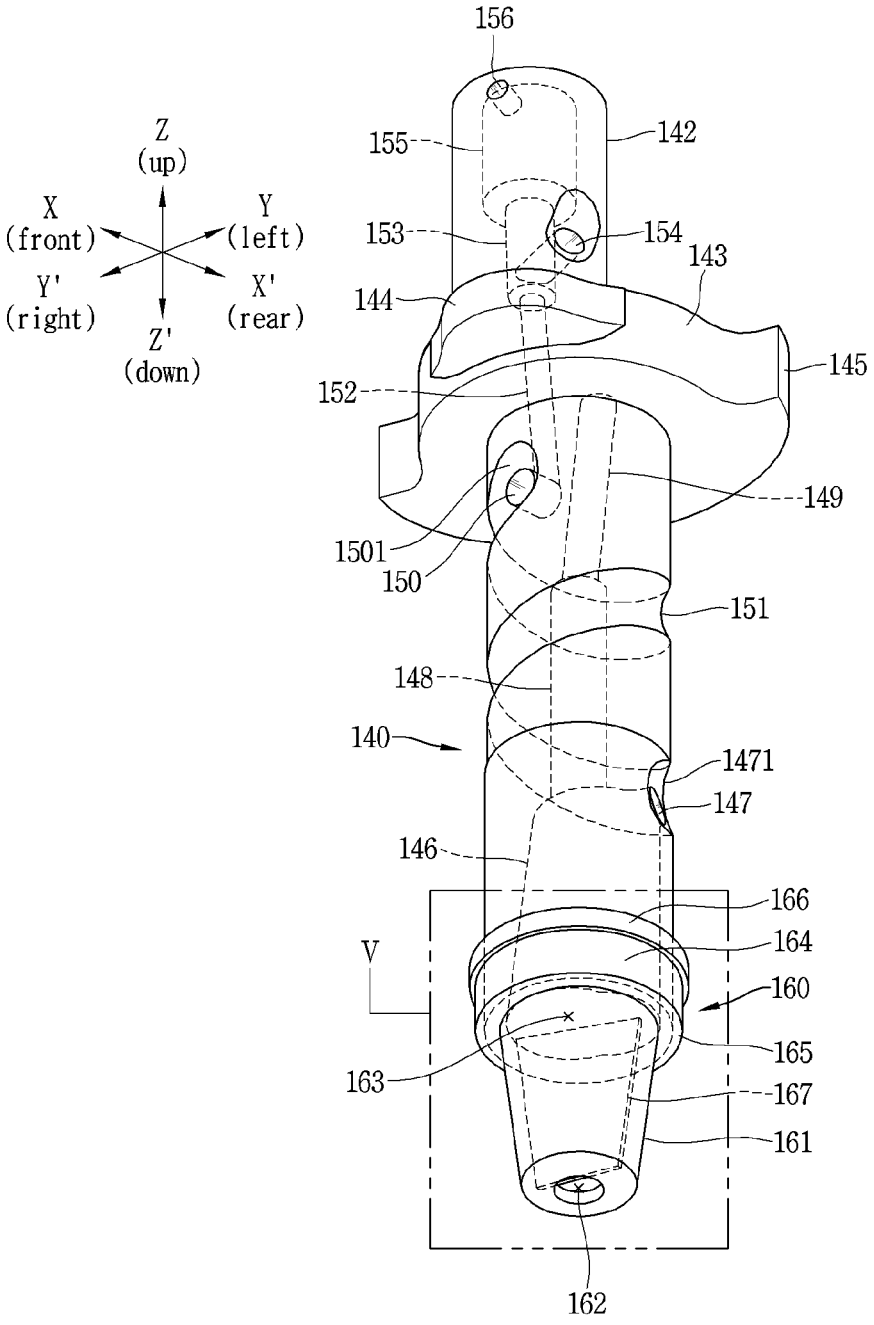
FIG. 4 is a perspective view illustrating a state in which an oil pump is mounted to a lower portion of a crankshaft in FIG. 3.
Figure 5:
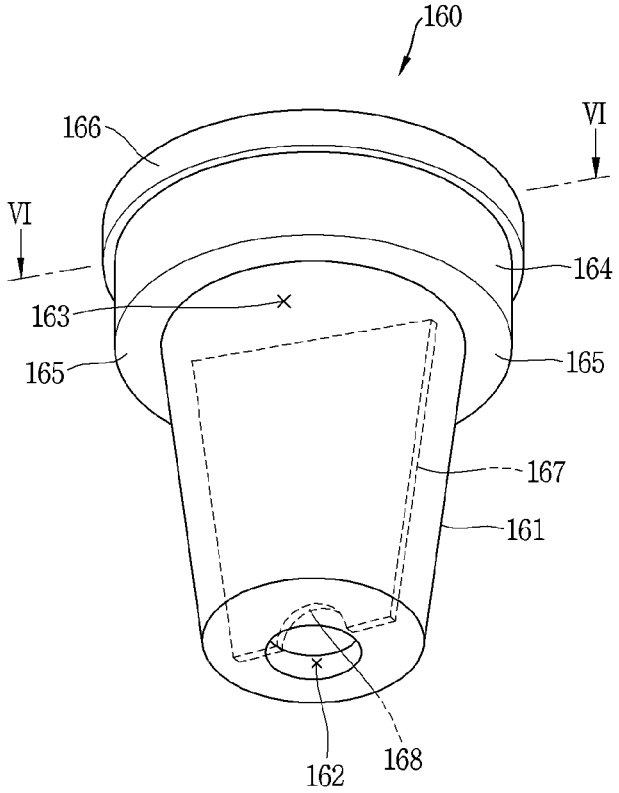
FIG. 5 is an enlarged view illustrating portion "V" (oil pump) in FIG. 4.
Figure 6:
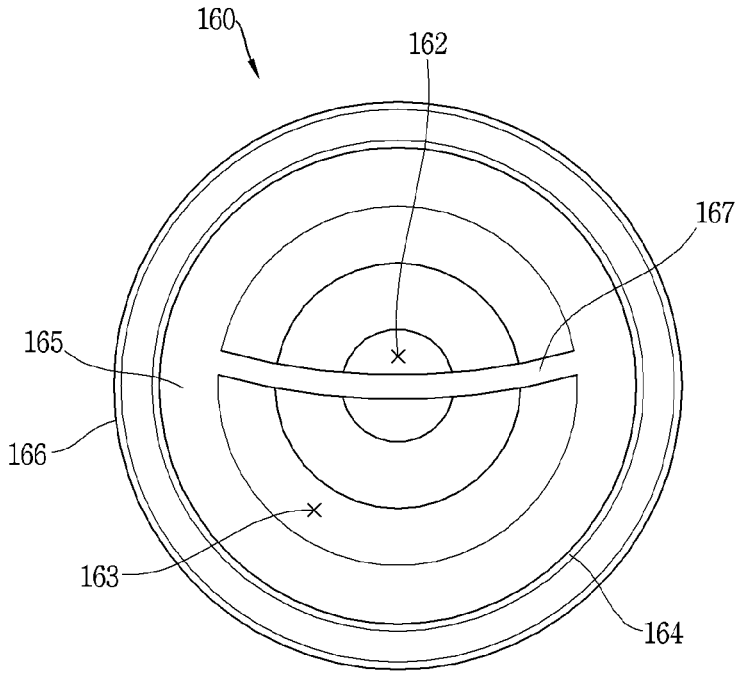
FIG. 6 is a planar view of the oil pump, taken along line VI-VI of FIG. 5.

FIG. 4 is a perspective view illustrating a state in which oil pump 160 is mounted to a lower portion of the crankshaft 140 in FIG. 3. FIG. 5 is an enlarged view illustrating portion "V" (oil pump 160) in FIG. 4. FIG. 6 is a planar view of the oil pump 160, taken along line VI-VI of FIG. 5.

A predetermined amount of oil may be filled in the lower region inside the shell 100. A sump may be formed in a curved or recessed form in the bottom portion of the shell 100. The oil may be stored in the sump. The oil may serve to lubricate mechanical parts or components of the compression unit 120 to prevent wear of the mechanical parts due to friction and to cool heat of the motor unit 110.

The oil pump 160 may be provided on or at a lower portion of the crankshaft 140. At least a part or portion of the oil pump 160 may be immersed in the oil. An upper end portion or end of the oil pump 160 may be coupled to a lower end portion or end of the crankshaft 140.

The oil pump 160 may be rotated by receiving the drive force from the crankshaft 140. The oil pump 160 may be configured to pump oil from the lower region of the shell 100 to the upper portion of the crankshaft 140.

The oil pump 160 may be implemented as a centrifugal pump that pumps oil using centrifugal force. The oil pump 160 may include a pump body 161, and an impeller 167.

The pump body 161 may define appearance of the oil pump 160. The pump body 161 may be located lower than the motor unit 110. An upper end portion or end of the pump body 161 may be located to correspond to a lower end portion or end of the motor unit 110.

The pump body 161 may be formed in a conical shape, for example. The pump body 161 may be formed in a penetrating manner such that oil may flow therein.

An inlet 162 may be provided in a lower end portion or end of the pump body 161. The lower end portion of the pump body 161 may have a diameter larger than a diameter of the inlet 162.

The inlet 162 may be formed through the lower end portion of the pump body 161 in the axial direction. The inlet 162 may be disposed to be immersed in oil. The oil contained in the sump may flow into the pump body 161 through the inlet 162.

An outlet 163 may be formed through an upper end portion or end of the pump body 161 in the axial direction. The outlet 163 may have a diameter larger than the diameter of the inlet 162. The diameter of the outlet 163 may be the same as or similar to a diameter of the crankshaft 140.

The oil introduced into the pump body 161 may flow out from the pump body 161 through the outlet 163. The oil may flow into the crankshaft 140 from the pump body 161. An oil passage structure inside the crankshaft 140 will be described hereinafter.

A side surface of the pump body 161 may be inclined from the inlet 162 to the outlet 163. A shaft coupling portion 164 may extend from the upper end portion of the pump body 161 in the axial direction. The shaft coupling portion 164 may have a diameter larger than that of the upper end portion of the pump body 161.

The shaft coupling portion 164 may be formed such that an outer diameter thereof is larger than an outer diameter of the crankshaft 140 and an inner diameter thereof is equal or similar to the outer diameter of the crankshaft 140. The lower end portion of the crankshaft 140 may be accommodated inside the shaft coupling portion 164. The lower end portion of the crankshaft 140 may be, for example, press-fitted into the shaft coupling portion 164.

A seating portion 165 may be provided on an upper end of the pump body 161. The seating portion 165 may be disposed between the upper end of the pump body 161 and a lower end of the shaft coupling portion 164. The seating portion 165 may be formed in a planar shape, for example. The seating portion 165 may extend outward from the upper end of the pump body 161 in the radial direction so as to have a larger diameter than that of the upper end of the pump body 161.

The seating portion 165 may be a portion which comes in surface-contact with a lower surface of the crankshaft 140 when the lower end portion of the crankshaft 140 is coupled into the shaft coupling portion 164. According to this embodiment, when the crankshaft 140 and the oil pump 160 are assembled, the seating portion 165 may allow stable assembly between the crankshaft 140 and the oil pump 160 without being biased to one side, thereby improving assemble efficiency.

A sealing portion 166 may be provided on an upper end of the shaft coupling portion 164. The sealing portion 166 may be formed on the upper end of the shaft coupling portion 164 to have a slightly larger diameter than that of the upper end of the shaft coupling portion 164.

A sealing member such as an O-ring may be inserted between an inner circumferential surface of the sealing portion 166 and an outer circumferential surface of the crankshaft 140. The sealing member may seal between the shaft coupling portion 164 and the crankshaft 140.

The impeller 167 may be provided inside the pump body 161. The impeller 167 may be configured as one wing. The impeller 167 may extend to cross an inner surface of the pump body 161 in the radial direction. In addition, the impeller 167 may extend in the axial direction along the inner surface of the pump body 161.

The impeller 167 may extend up to the seating portion 165 in the axial direction from the inlet 162 toward the outlet 163 of the pump body 161. The impeller 167 may be integrally formed with an inner circumferential surface of the pump body 161.

One or a first end portion or end of the impeller 167 may be integrally connected to one or a first side of the inner circumferential surface of the pump body 161, and another or a second end portion or end of the impeller 167 may be integrally connected to another or a second side of the inner circumferential surface of the pump body 161 that faces the one side of the inner circumferential surface of the pump body 161 in the radial direction. The impeller 167 may divide an inner space of the pump body 161 approximately into two spaces. For example, the inner space of the pump body 161 may be divided into a first space and a second space by the impeller 167. The first space and the second space may be formed asymmetrically so that volumes thereof are different from each other.

For example, the impeller 167 may be formed in a parabolic shape that passes through a center of the pump body 161 and crosses the inner space of the pump body 161 between the first space and the second space when viewed from a top of the pump body 161. The first space may have a volume smaller than a volume of the second space.

The impeller 167 may be formed in a curved or planer shape, for example. In this embodiment, the impeller 167 may be formed in a curved shape having a preset or predetermined curvature.

The impeller 167 may have a curvature smaller than a curvature of the upper end portion of the pump body 161. According to this embodiment, the impeller 167 may be formed in the curved shape, which may be more effective in terms of rotating oil in one direction.

A communication groove 168 may be provided in a lower end portion or end of the impeller 167. The communication groove 168 may be formed through the impeller 167 in a thickness direction of the impeller 167. The communication groove 168 may be formed through the pump body 161 in the radial direction of the pump body 161. The communication groove 168 may allow the first space and the second space to communicate with each other.

The impeller 167 may rotate together with the pump body 161 by receiving the drive force from the crankshaft 140 while being immersed in oil. According to this embodiment, the impeller 167 may suction the oil stored in the lower region of the shell 100 into the first space and the second space of the pump body 161 by centrifugal force.

Hereinafter, crankshaft 140 will be described.

Figure 7:
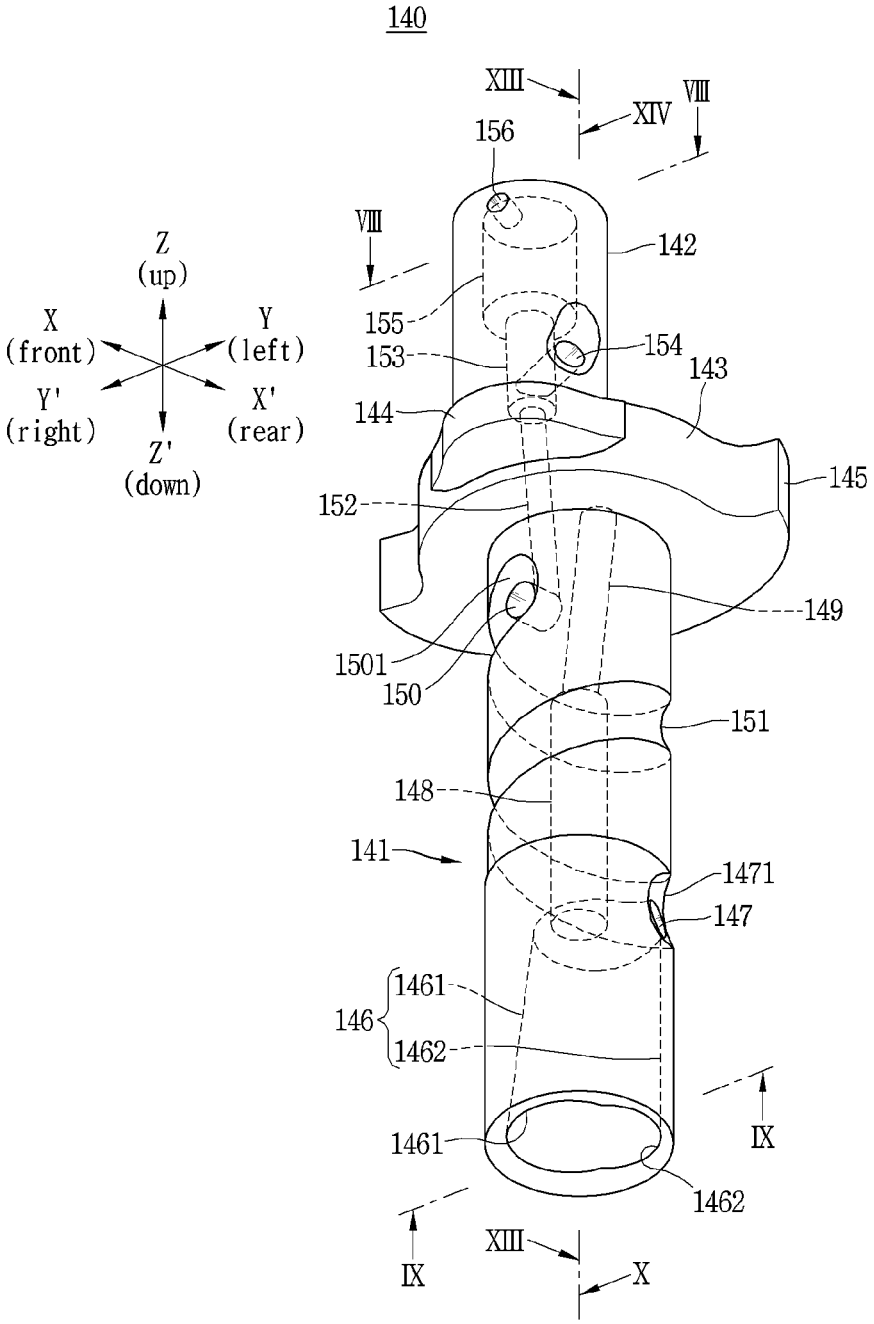
FIG. 7 is a perspective view illustrating the crankshaft of FIG. 6.
Figure 8:
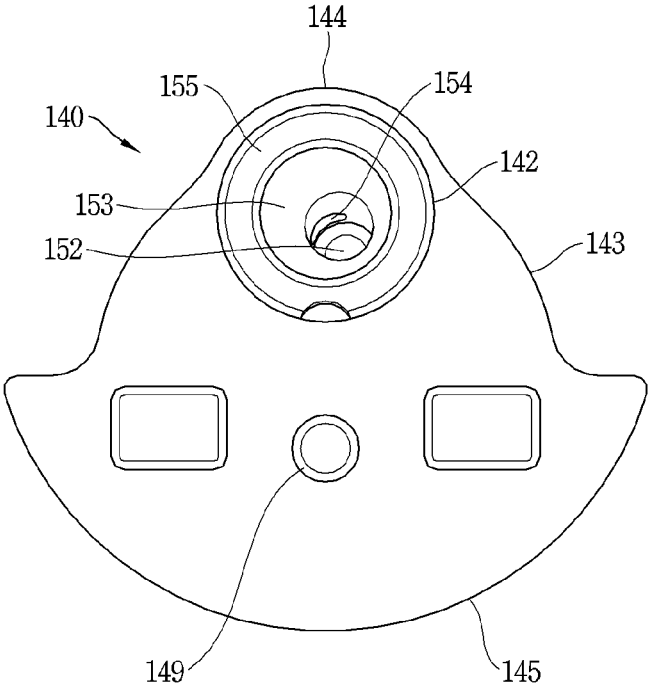
FIG. 8 is a planar view illustrating the crankshaft, viewed from a top, taken along line VIII-VIII of FIG. 7.
Figure 9:
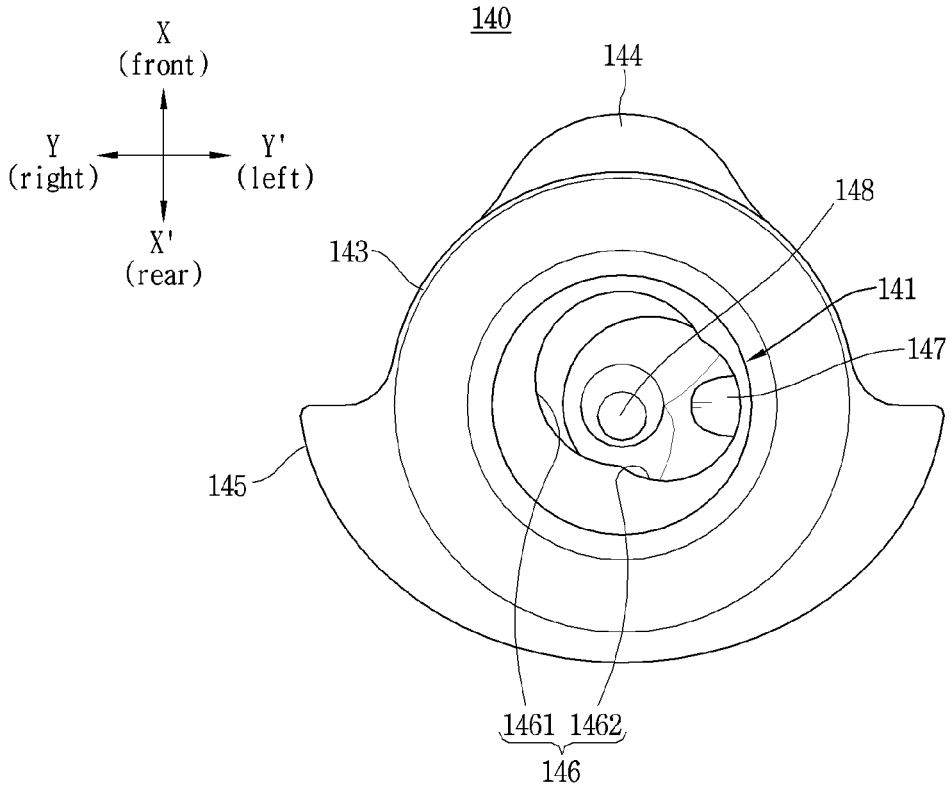
FIG. 9 is a bottom view illustrating the crankshaft, viewed from a bottom, taken along line IX-IX in FIG. 7.
Figure 10:
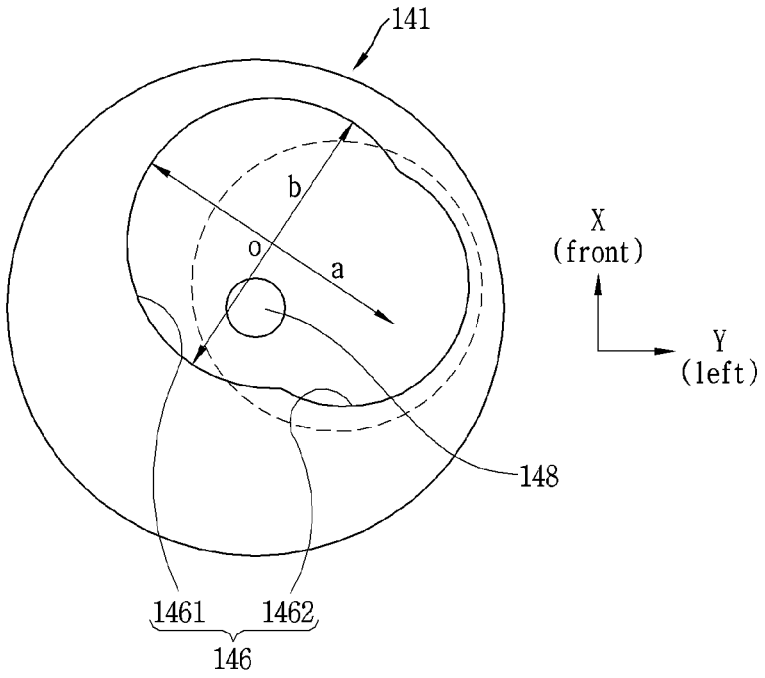
FIG. 10 is a conceptual view illustrating a shape of a lower end portion of a hollow hole viewed from a bottom of a main journal in FIG. 9.
Figure 11:
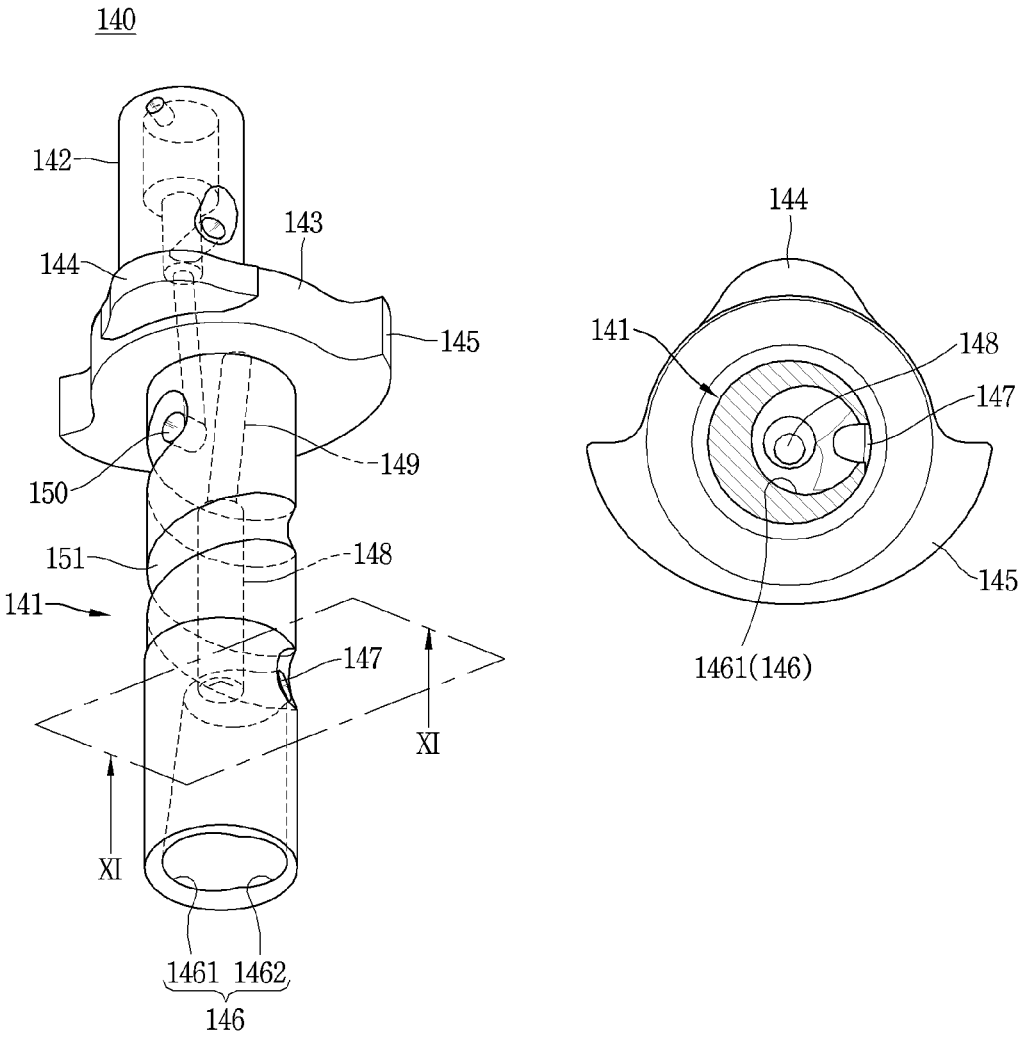
FIG. 11 is a cross-sectional view of a portion of the crankshaft indicated by XI-XI, cut horizontally along a surface passing through a center of a lower communication hole, which shows a shape of an upper end portion of the hollow hole viewed from the bottom.
Figure 12:
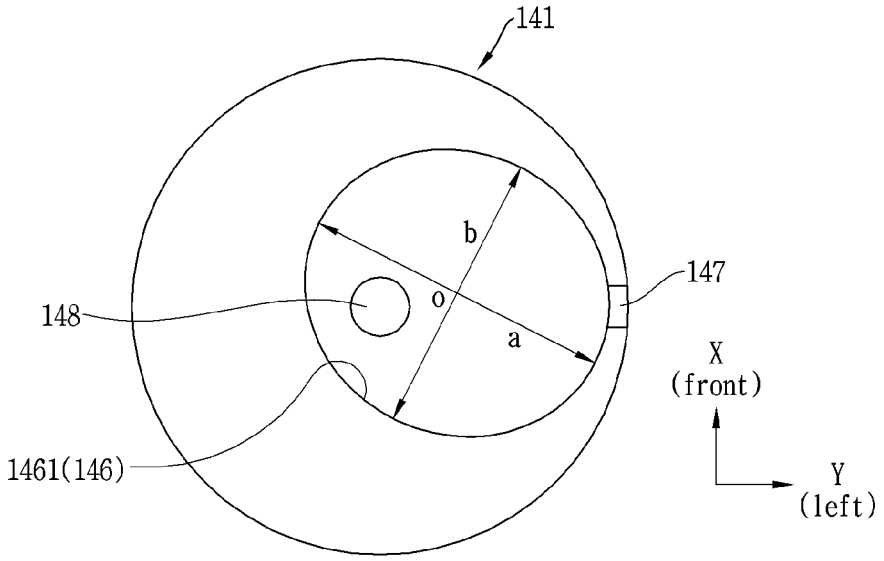
FIG. 12 is a conceptual view illustrating a connection structure between an upper end portion of the hollow hole and the lower communication hole formed inside of the main journal in FIG. 11.
Figure 13:
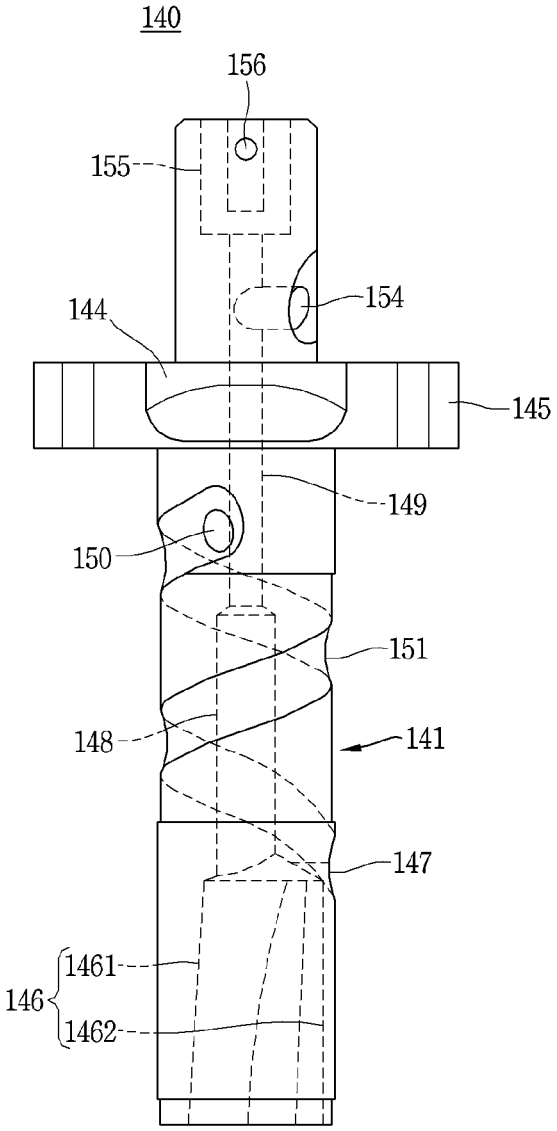
FIG. 13 is a front view illustrating the crankshaft, viewed from a front, taken along line XIII-XIII of FIG. 7.
Figure 14:
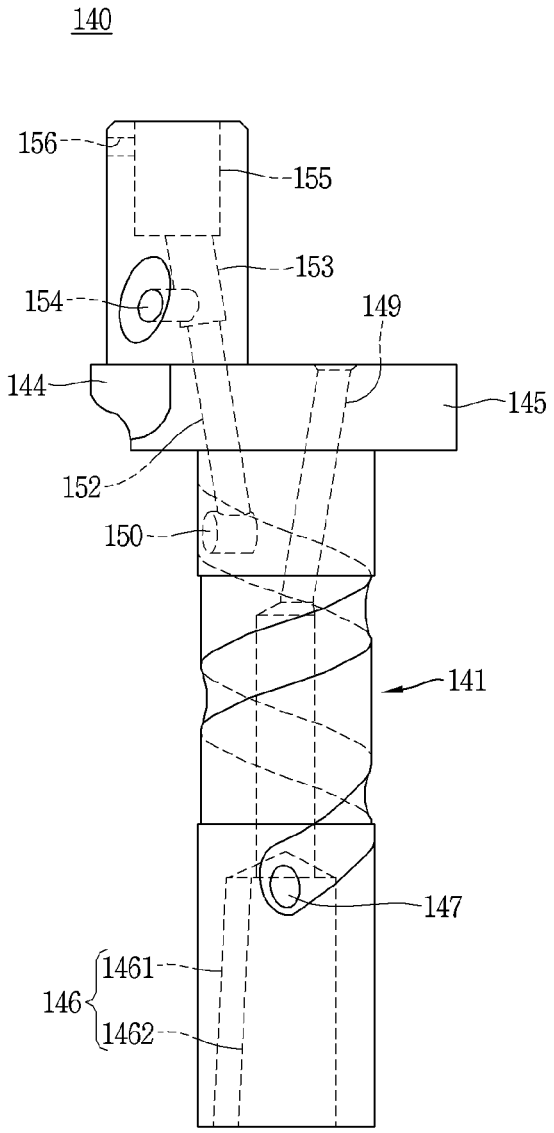
FIG. 14 is a lateral view, taken along line XIV-XIV of FIG. 7.

FIG. 7 is a perspective view illustrating the crankshaft 140 of FIG. 6. FIG. 8 is a planar view illustrating the crankshaft 140, viewed from a top, taken along line VIII-VIII of FIG. 7. FIG. 9 is a bottom view illustrating the crankshaft 140, viewed from a bottom, taken along line IX-IX of FIG. 7. FIG. 10 is a conceptual view illustrating a shape of a lower end portion of a hollow hole 146, viewed from a bottom of a main journal 141 in FIG. 9. FIG. 11 is a cross-sectional view of a part of the crankshaft 140 indicated by XI-XI, cut horizontally along a surface passing through a center of the lower communication hole 147, which shows a shape of an upper end portion of the hollow hole 146 viewed from the bottom. FIG. 12 is a conceptual view illustrating a connection structure between the upper end portion of the hollow hole 146 and the lower communication hole 147 formed inside the main journal 141 in FIG. 11. FIG. 13 is a front view illustrating the crankshaft 140, viewed from a front, taken along line XIII-XIII of FIG. 7. FIG. 14 is a lateral view, taken along line XIV-XIV of FIG. 7.

Figure 15:
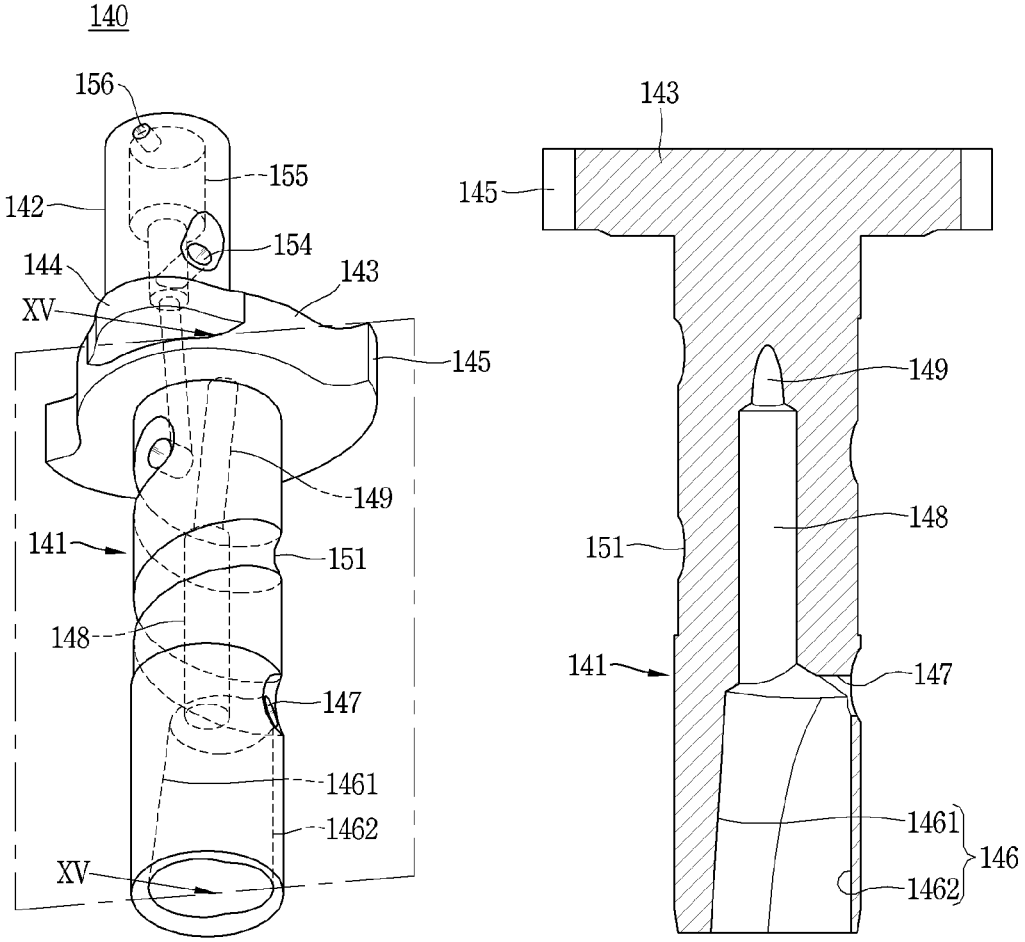
FIG. 15 is a cross-sectional view of a portion of the crankshaft indicated by XV-XV, cut vertically along a surface passing through the center of the lower communication hole, which shows an oil passage inside of the crankshaft.
Figure 16:
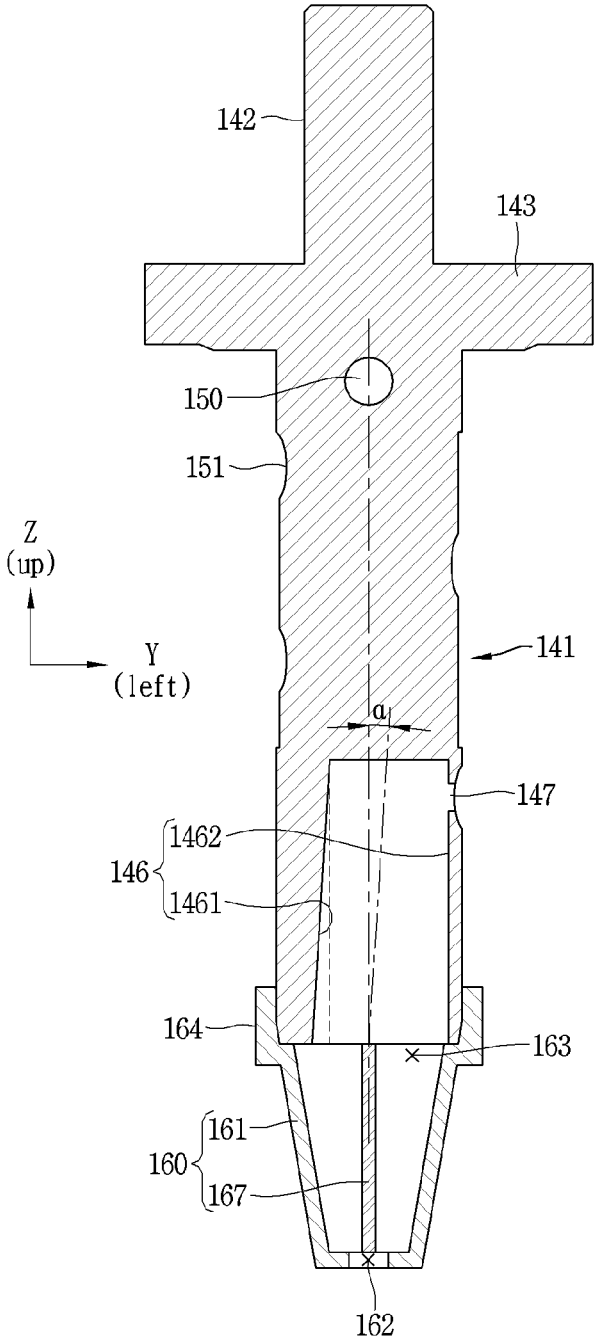
FIG. 16 is a conceptual view illustrating a cross-sectional shape (YZ) of an inclined hole and a vertical hole in the crankshaft of FIG. 15.
Figure 17:
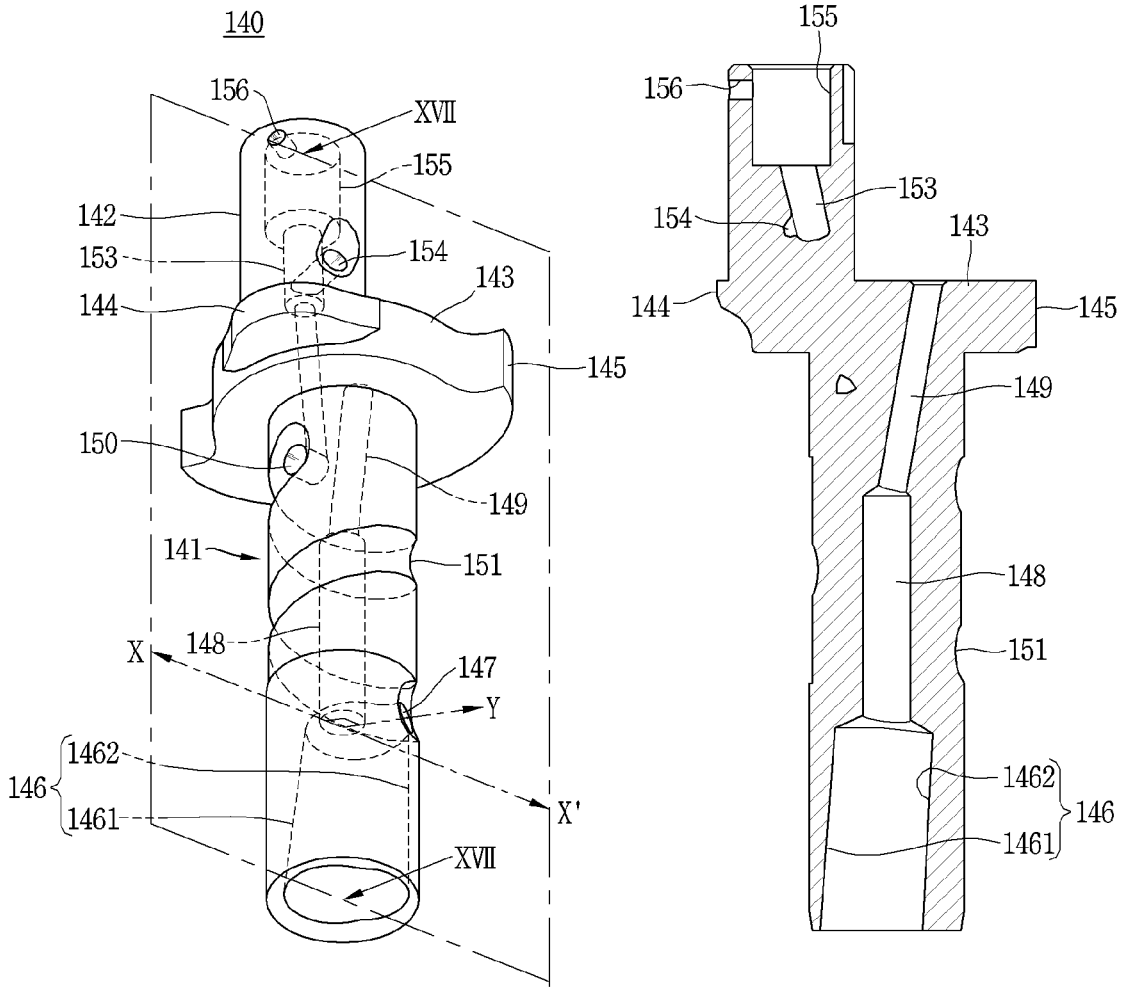
FIG. 17 is a cross-sectional view of a portion of the crankshaft indicated by XVII-XVII, cut in a direction forming a right angle with respect to the lower communication hole in a circumferential direction, which shows the oil passage inside the crankshaft.
Figure 18:
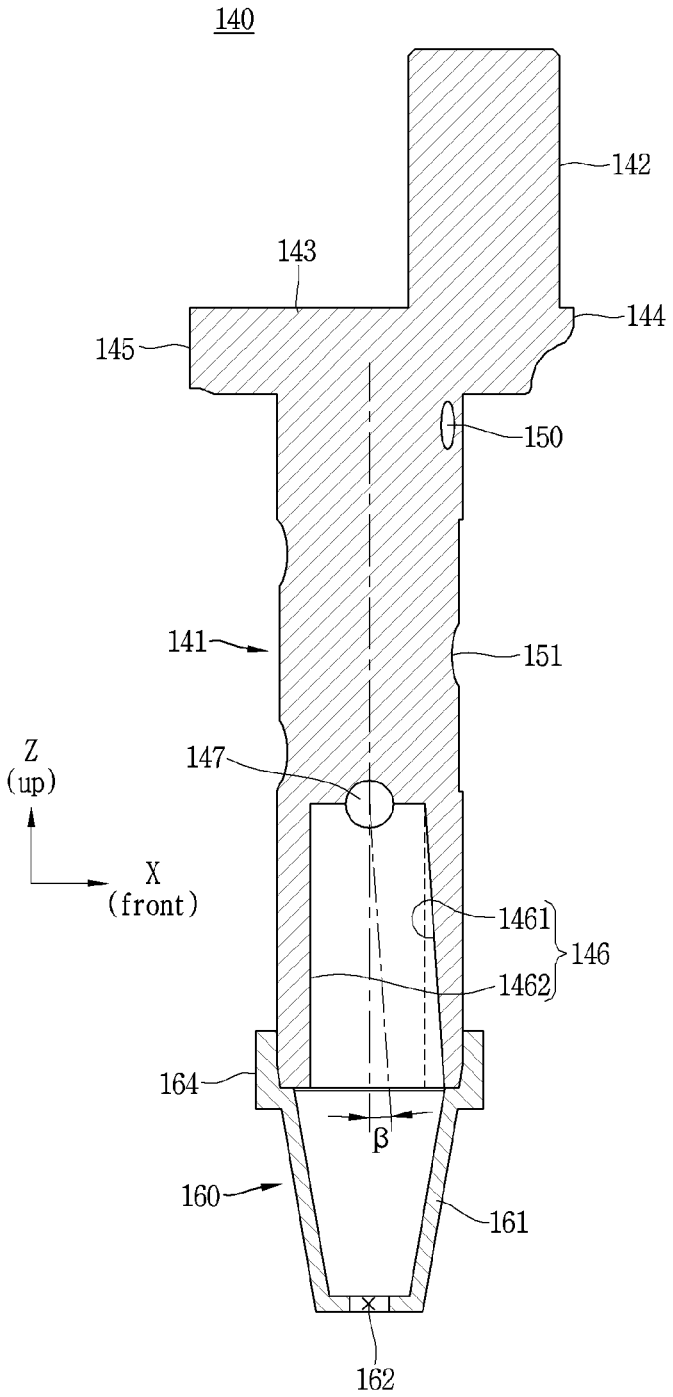
FIG. 18 is a conceptual view illustrating a cross-sectional shape (XZ) of the inclined hole and the vertical hole in the crankshaft of FIG. 17.
Figure 19:
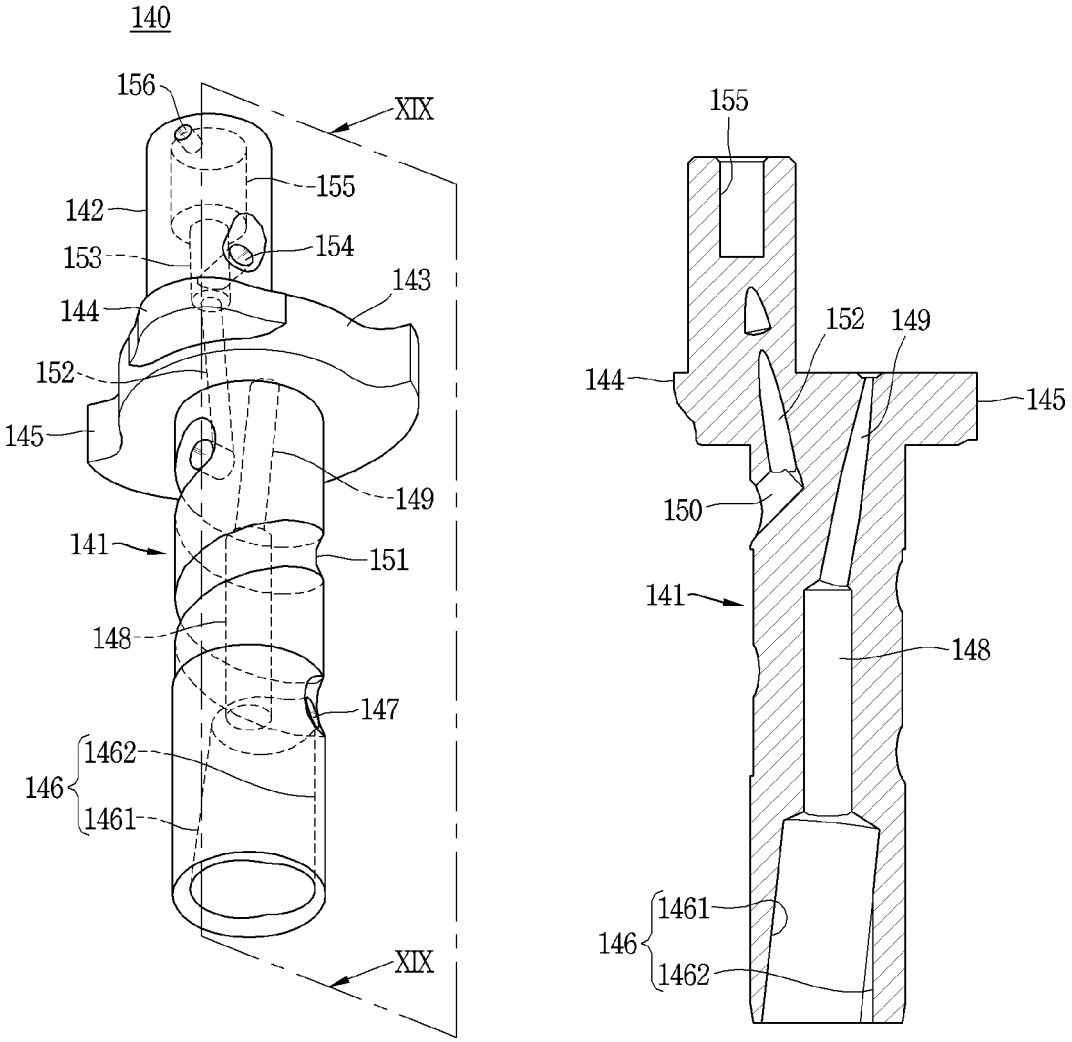
FIG. 19 is a cross-sectional view of a portion of the crankshaft indicated by XIX-XIX, cut along a surface passing through a center of an upper communication hole, which shows the oil passage inside of the crankshaft.

FIG. 15 is a cross-sectional view of a part of the crankshaft 140 indicated by XV-XV, cut vertically along a surface passing through the center of the lower communication hole 147, which shows an oil passage inside the crankshaft 140. FIG. 16 is a conceptual view illustrating a cross-sectional shape (YZ) of an inclined hole 1461 and a vertical hole 1462 in the crankshaft 140 of FIG. 15. FIG. 17 is a cross-sectional view of a part of the crankshaft 140 indicated by XVII-XVII, cut in a direction forming a right angle with respect to the lower communication hole 147 in a circumferential direction, which shows the oil passage inside the crankshaft 140. FIG. 18 is a conceptual view illustrating a cross-sectional shape (XZ) of the inclined hole 1461 and the vertical hole 1462 in the crankshaft 140 of FIG. 17. FIG. 19 is a cross-sectional view of a part of the crankshaft 140 indicated by XIX-XIX, cut along a surface passing through a center of an upper communication hole 150, which shows the oil passage inside the crankshaft 140.

The crankshaft 140 may include a main journal 141, a flange portion or flange 143, eccentric shaft 142, a protrusion 144, and a balance weight 145. The main journal 141 may be accommodated inside the center of the frame 130 (more precisely, the shaft support portion 123) of the cylinder block 121. The main journal 141 may be supported with a gap from the shaft support portion 123 to be rotatable relative to the shaft support portion 123.

The main journal 141 may be perpendicularly disposed in the vertical direction. A lower portion of the main journal 141 may be coupled to the shaft coupling portion 164 of the rotor core 115. The main journal 141 may be rotated in place together with the rotor 114 while being perpendicularly disposed.

The flange portion 143 may horizontally extend outward from an upper end portion or end of the main journal 141 in the radial direction. The flange portion 143 may be brought into contact with thrust bearing 124 so as to support an axial load of the crankshaft 140.

The eccentric shaft 142 may protrude upward from one side of an upper surface of the flange portion 143. The eccentric shaft 142 may be disposed to be eccentric from a center of the flange portion 143 toward an outside in the radial direction. The eccentric shaft 142 may perform an orbital motion around the main journal 141. One or a first side of the eccentric shaft 142 may be disposed on an upper surface of the flange portion 143, and another or a second side of the eccentric shaft 142 may be disposed outside the flange portion 143.

The protrusion 144 may protrude forward from a front surface of the flange portion 143. The protrusion 144 may be disposed on a lower portion of the eccentric shaft 142. The protrusion 144 may be disposed to overlap a part or portion of the eccentric shaft 142 in the vertical direction.

The protrusion 144 may be formed such that a forwardly-protruding length increases from both a left or first end or side to a right or second end or side of the protrusion 144 to a central portion of the protrusion 144 when an upper surface of the protrusion 144 is viewed from the top of the crankshaft 140. According to this embodiment, the protrusion 144 may support the axial load of the eccentric shaft 142. The protrusion 144 may reinforce rigidity of the flange portion 143.

The balance weight 145 may be provided on a rear side of the flange portion 143 to be balanced with an eccentric load of the eccentric shaft 142. The balance weight 145 may be disposed at an opposite side to the protrusion 144.

The balance weight 145 may protrude radially outward from an outer circumferential surface of the flange portion 143. The balance weight 145 may extend along the circumferential direction by a half-length of a circumference of the flange portion 143 based on a radial center line passing through the center of the flange portion 143 in the radial direction.

The balance weight 145 may be formed such that a radially protruding length increases from a central portion of the balance weight 145 toward both end portions or ends of the balance weight 145 when the upper surface of the flange portion 143 is viewed from the top of the crankshaft 140.

The crankshaft 140 may be provided with an oil passage. A lower side of the oil passage may communicate with the outlet 163 of the oil pump 160. An upper side of the oil passage may communicate with an upper space of the shell 100, namely, a space defined between an upper side of the compression unit 120 and the cover shell 105.

Oil pumped by the oil pump 160 may move upward along the oil passage of the crankshaft 140 so as to lubricate a friction surface between the motor unit 110 and the compression unit 120 or to cool heat generated from the motor unit 110.

The crankshaft 140 may include a hollow hole 146, an intermediate hole 148, an upper hole 149, a lower communication hole 147, an outer circumferential passage groove 151, an upper communication hole 150, an eccentric shaft connection hole 152, a first eccentric shaft header 153, an eccentric shaft radial hole 154, a second eccentric shaft header 155, and an eccentric shaft spray hole 156.

The main journal 141 may include a lower journal, an intermediate journal, and an upper journal depending on a height. The main journal 141 may extend axially with a constant diameter from the lower journal to the upper journal. The main journal 141 may be formed in a cylindrical shape, for example.

The lower journal may be disposed to overlap the shaft coupling portion 164 of the rotor core 115 in the radial direction. A lower portion of the lower journal may protrude downward from a lower end of the rotor core 115.

The intermediate journal may be disposed to overlap the shaft support portion accommodating portion of the rotor core 115 in the radial direction. The intermediate journal may be disposed to overlap a lower portion of the shaft support portion 123 of the frame 130 in the radial direction. The intermediate journal may be disposed to be accommodated inside the rotor core 115.

The upper journal may be disposed to overlap an upper portion of the shaft support portion 123 of the frame 130 in the radial direction. The upper journal may be disposed outside the rotor core 115.

Hereinafter, hollow hole 146 may be classified into three types of embodiments according to a shape and structure thereof.

Hollow hole 146 of a dual-axis inclined and vertical type may be provided inside the lower journal. As the hollow hole 146 is formed in the lower portion of the main journal 141, it may be referred to as a "lower hole".

A lower side of the hollow hole 146 may communicate with the outlet 163 of the oil pump 160. An upper side of the hollow hole 146 may communicate with the lower communication hole 147 described hereinafter.

The hollow hole 146 may allow the outlet 163 of the oil pump 160 to communicate with the lower communication hole 147 in the vertical direction. The hollow hole 146 may be inclined in two directions with respect to a perpendicular center line that passes through a center of the main journal 141 in the axial direction. The hollow hole 146 may be eccentric in one direction from the center of the main journal 141.

The hollow hole 146 may include at least one of an inclined hole 1461 inclined at a preset or predetermined angle with respect to the perpendicular center line of the main journal 141, and a vertical hole 1462 eccentric from the center of the main journal 141 and formed vertically in the axial direction.

This embodiment illustrates that the hollow hole 146 is formed as a combination of the inclined hole 1461 and the vertical hole 1462. The inclined hole 1461 may be formed in a cylindrical shape inclined at the preset angle with respect to the perpendicular center line of the main journal 141. The inclined hole 1461 may have a cross-sectional in an elliptical shape when cut in the radial direction perpendicular to the axial direction of the main journal 141.

The inclined hole 1461 may be inclined in two directions with respect to the perpendicular center line. Assuming that the perpendicular center line is a Z-axis direction, the two directions may be an X-axis direction (frontward and rearward direction) and a Y-axis direction (leftward and rightward direction). The X-axis, Y-axis and Z-axis may extend perpendicular to one another. The X-axis may extend in the frontward and rearward direction, the Y-axis may extend in the leftward and rightward direction, and the Z-axis may extend in the vertical direction or axial direction.

For example, the inclined hole 1461 may be inclined in two directions, namely, the X-axis direction and the Y-axis direction, which are perpendicular to each other based on the perpendicular center line (Z-axis). That is, the inclined hole 1461 may be inclined at a preset or predetermined first angle $\alpha$ when projected on a YZ plane in the X-axis direction, while inclined at a preset or predetermined second angle $\beta$ when projected on an XZ plane in the Y-axis direction.

The inclined hole 1461 may have a cross-section in an elliptical shape in the radial direction, for example. The inclined hole 1461 may be eccentric to one side from the center of the main journal 141. For example, when viewing a lower end portion of the main journal 141 from the bottom of the crankshaft 140 in the axial direction, the inclined hole 1461 may be eccentric toward the protrusion 144.

A major axis a of the inclined hole 1461 passing through two focal points of an ellipse and a minor axis b of the inclined hole 1461 perpendicular to the major axis a may extend respectively in directions intersecting with a first radial center line (XX' axis line, frontward and rearward direction) passing through the central portion of the protrusion 144 in the radial direction, and a second radial center line (YY' axis line, leftward and rightward direction) passing through both end portions of the balance weight 145 in the radial direction.

A center of a lower end portion of the inclined hole 1461 may be eccentric from the center of the main journal 141 toward the center of the protrusion 144.

The vertical hole 1462 may extend in the axial direction of the main journal 141. The vertical hole 1462 may be formed in a cylindrical shape, for example. The vertical hole 1462 may be perpendicularly disposed in the axial direction. The vertical hole 1462 may have a cross section in a circular shape, for example.

The vertical hole 1462 may be eccentric from the center of the main journal 141 in one direction. A center of the vertical hole 1462 may be radially spaced apart from the center of the main journal 141.

The inclined hole 1461 and the vertical hole 1462 may be formed to overlap each other on the XY plane or in the radial direction of the main journal 141. The inclined hole 1461 and the vertical hole 1462 may be connected to communicate with each other in the direction of the major axis a of the inclined hole 1461 having the elliptical shape or in the radial direction of the vertical hole 1462.

A partial region of the inclined hole 1461 having the cross-section in the elliptical shape may be included in an overlapped region between the inclined hole 1461 and the vertical hole 1462. A partial region of the vertical hole 1462 having the cross-section in the circular shape may also be included in an overlapped region between the inclined hole 1461 and the vertical hole 1462.

The intermediate hole 148 may be provided inside the intermediate journal. The intermediate hole 148 may communicate with the upper end portion of the hollow hole 146. The hollow hole 148 may be formed through the main journal 141 in the axial direction. The intermediate hole 148 may extend in the axial direction of the main journal 141.

The upper hole 149 may be provided inside the upper journal. The upper hole 149 may be inclined with respect to the perpendicular center line of the main journal 141. An upper end portion of the upper hole 149 may be connected to communicate with the inner space of the shell 100, and a lower end portion of the upper hole 149 may be connected to communicate with an upper end portion of the intermediate hole 148.

A center of the lower end portion of the upper hole 149 may be located at the center of the main journal 141. A center of the upper end portion of the upper hole 149 may be eccentric from the center of the flange portion 143 in the radial direction. According to this embodiment, oil pumped by the centrifugal pump may be sprayed in an upward direction of the cover shell 105 through the upper hole 149.

The upper hole 149 may be disposed to be eccentric from the center of the flange portion 143. The upper hole 149 may be disposed adjacent to the center of the flange portion 143. Accordingly, oil may be sprayed through the upper hole 149 while performing an orbital motion around the center of the flange portion 143.

The oil sprayed upward through the upper hole 149 may be sprayed onto an upper surface inside the cover shell 105 and then deflected down toward the compression unit 120, so as to be spread widely on an upper surface of the compression unit 120.

The lower communication hole 147 may be disposed between the lower journal and the intermediate journal. The lower communication hole 147 may allow the hollow hole 146, which is an inner flow path of the main journal 141, to communicate with the outer circumferential passage groove 151, which is an outer flow path.

The lower communication hole 147 may be connected to an upper side of the hollow hole 146 in a communicating manner. The lower communication hole 147 may be formed through the main journal 141 in the radial direction.

An inner side of the lower communication hole 147 may be connected to communicate with the upper end portion or end of the hollow hole 146, and an outer side of the lower communication hole 147 may be connected to communicate with the lower end portion of the outer circumferential passage groove 151. A first recess 1471 may be recessed in a conical shape into the outer side of the lower communication hole 147. According to this embodiment, the hollow hole 146 and the outer circumferential passage groove 151 may communicate with each other through the lower communication hole 147.

The first recess 1471 may be formed such that a passage at an outer end portion of the lower communication hole 147 and a lower end portion of the outer circumferential passage groove 151 is formed in a smooth curved shape rather than at a right angle. This structure may facilitate a flowing direction of oil to change from the radial direction of the main journal 141 into a spiral direction and minimize flow resistance of the oil.

The outer circumferential passage groove 151 may be provided on an outer circumferential surface of the main journal 141. The outer circumferential passage groove 151 may extend along the outer circumferential surface of the main journal 141 in a spiral direction.

The outer circumferential passage groove 151 may extend along the outer circumferential surface of the main journal 141 in the spiral direction in an angular range between 360 degrees and 720 degrees based on the circumferential direction. However, a length of the outer circumferential passage groove 151 may not be limited to this. The outer circumferential passage groove 151 may be formed at the intermediate journal and the upper journal.

A gap may be formed between the inner circumferential surface of the shaft support portion 123 of the frame 130 and the outer circumferential surface of the main journal 141. The outer circumferential passage groove 151 may be configured to be covered by the shaft support portion 123 of the frame 130. A space between the inner circumferential surface of the shaft support portion 123 and the outer circumferential passage groove 151 may be relatively wider than the gap, thereby causing less flow resistance.

The space between the outer circumferential passage groove 151 and the inner circumferential surface of the shaft support portion 123 may define a passage along which oil may spirally flow along the outer circumferential surface of the main journal 141.

As the crankshaft 140 rotates, the outer circumferential passage groove 151 may also rotate. Accordingly, oil may flow along the outer circumferential surface of the main journal 141 in the axial direction. The oil moving upward along the outer circumferential passage groove 151 may lubricate a friction surface between the outer circumferential surface of the main journal 141 and the shaft support portion 123.

The outer circumferential passage groove 151 may allow oil to flow from outside of the main journal 141 to the inside of the main journal 141. For this purpose, upper communication hole 150 may be provided in or at an upper end portion or end of the outer circumferential passage groove 151.

The upper communication hole 150 may extend in the radial direction of the main journal 141. An outer side of the upper communication hole 150 may be connected to communicate with the upper end portion of the outer circumferential passage groove 151. An inside of the upper communication hole 150 may communicate with an eccentric shaft connection hole 152 described hereinafter.

The upper communication hole 150 may be inclined upward from the outside to inside of the main journal 141 in the radial direction. An inner end portion or end of the upper communication hole 150 may be located higher than an outer end portion or end of the upper communication hole 150.

The eccentric shaft connection hole 152 may extend from an inside of the upper journal of the main journal 141 to the inside of the eccentric shaft 142. The eccentric shaft connection hole 152 may allow the upper communication hole 150 to be connected to first eccentric shaft header 153 described hereinafter. A lower end portion or end of the eccentric shaft connection hole 152 may be connected to communicate with the inner end portion of the upper communication hole 150. An upper end portion or end of the eccentric shaft connection hole 152 may be connected to communicate with a lower end portion or end of the first eccentric shaft header 153.

The eccentric shaft connection hole 152 may be inclined toward the lower end portion of the first eccentric shaft header 153 from the inner end portion of the upper communication hole 150. The lower end portion of the eccentric shaft connection hole 152 may be provided inside the upper journal. The upper end portion of the eccentric shaft connection hole 152 may be provided inside the lower portion of the eccentric shaft 142.

The first eccentric shaft header 153 may be provided inside the eccentric shaft 142. The first eccentric shaft header 153 may have a diameter larger than a diameter of the eccentric shaft connection hole 152.

The first eccentric shaft header 153 may be formed in a cylindrical shape, for example. The first eccentric shaft header 153 may be inclined at a preset or predetermined angle with respect to the perpendicular center line of the eccentric shaft 142.

The second eccentric shaft header 155 may be provided inside the eccentric shaft 142. The second eccentric shaft header 155 may be disposed on a top of the first eccentric shaft header 153. The second eccentric shaft header 155 may be formed in a cylindrical shape, for example.

The second eccentric shaft header 155 may have a diameter larger than the diameter of the first eccentric shaft header 153. The second eccentric shaft header 155 may extend through the eccentric shaft 142 in the axial direction.

A lower side of the second eccentric shaft header 155 may communicate with an upper side of the first eccentric shaft header 153, and an upper side of the second eccentric shaft header 155 may communicate with the inner space of the shell 100.

The first eccentric shaft header 153 and the second eccentric shaft header 155 may temporarily store oil. The first eccentric shaft header 153 may transfer oil from the inside to outside of the eccentric shaft 142.

An eccentric shaft radial hole 154 may be provided in the first eccentric shaft header 153. The eccentric shaft radial hole 154 may extend from the first eccentric shaft header 153 in the radial direction. An inner side or end of the eccentric shaft radial hole 154 may be connected to communicate with the first eccentric shaft header 153, and an outer side or end of the eccentric shaft radial hole 154 may be connected to communicate with the outer circumferential surface of the eccentric shaft 142.

An outer end portion or end of the eccentric shaft radial hole 154 may communicate with a friction surface between the eccentric shaft 142 and the connecting rod 131, that is, a space between the outer circumferential surface of the eccentric shaft 142 and an inner circumferential surface of the eccentric shaft coupling portion 1311 of the connecting rod 131.

A recess may be formed in the outer end portion of the eccentric shaft radial hole 154. The recess may be formed in a conical shape, for example. The recess may secure a larger space than a space between the eccentric shaft 142 and the connecting rod 131 so as to temporarily store oil and smoothly supply the oil to the friction surface between the eccentric shaft 142 and the connecting rod 131.

The second eccentric shaft header 155 may include eccentric shaft spray hole 156 for spraying oil into the inner space of the shell. The eccentric shaft spray hole 156 may be formed through a side surface of the second eccentric shaft header 155 in the radial direction.

An inner side or end of the eccentric shaft spray hole 156 may be connected to communicate with the second eccentric shaft header 155, and an outer side or end of the eccentric shaft spray hole 156 may be connected to communicate with the inner space of the shell 100. The eccentric shaft spray hole 156 may be disposed in the upper end portion of the second eccentric shaft header 155. A diameter of the eccentric shaft spray hole 156 may be much smaller than the diameter of the second eccentric shaft header 155.

The second eccentric shaft header 155 may have a preset or predetermined diameter (size) and may be formed in a cylindrical shape. Accordingly, the second eccentric shaft header 155 may sufficiently supply oil to the eccentric shaft spray hole 156.

Figure 20:
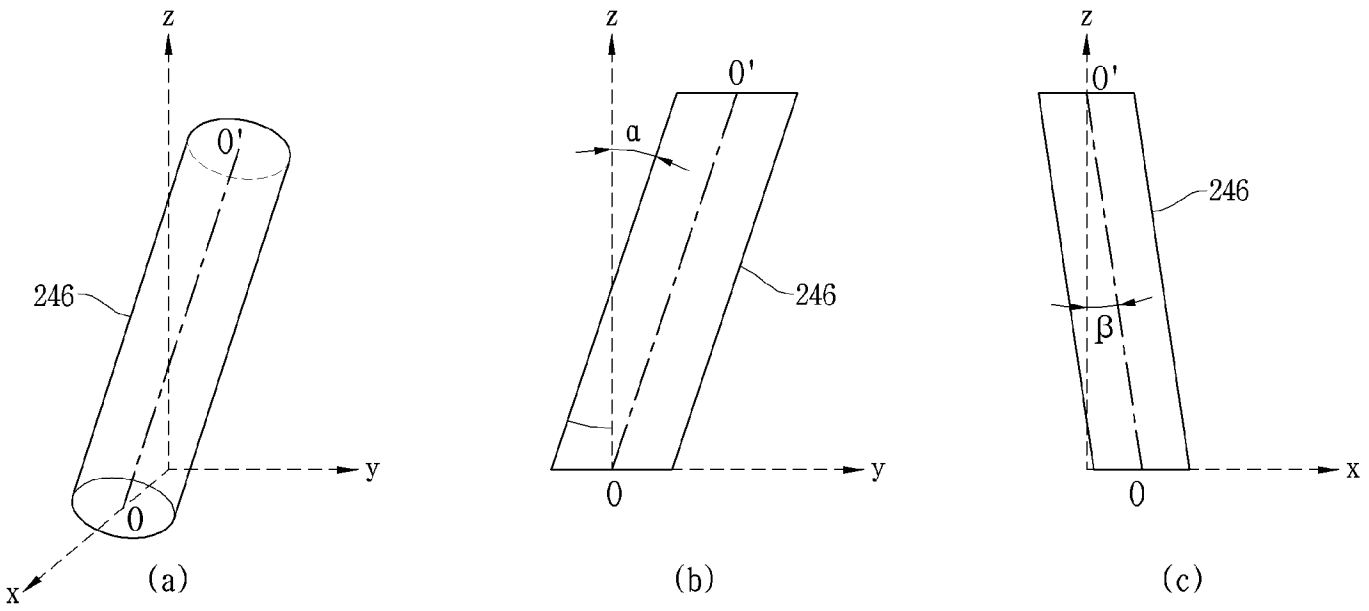
FIG. 20 is a conceptual view illustrating a hollow hole of a dual-axis inclined type in accordance with another embodiment.
Figure 21:
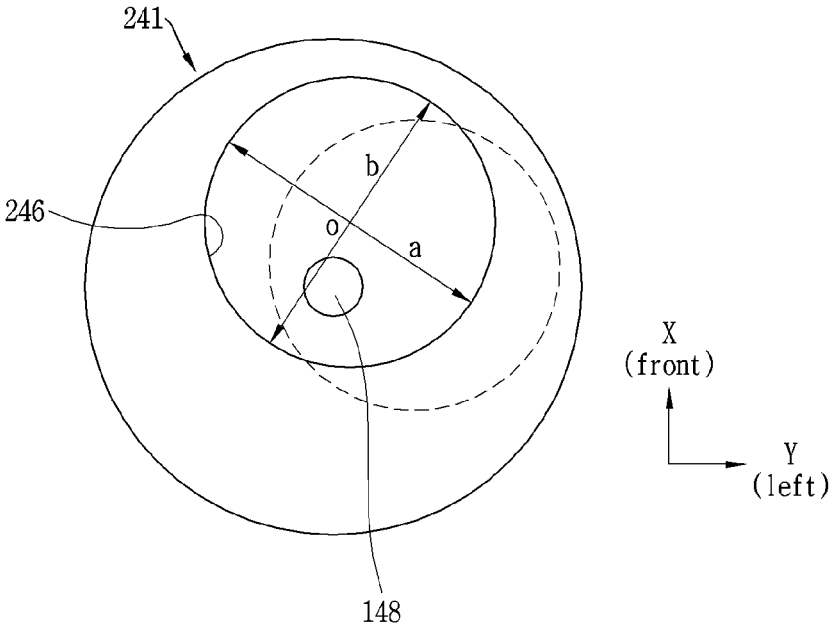
FIG. 21 is a conceptual view illustrating a crankshaft having the hollow hole of FIG. 20, viewed upward from a bottom.

FIG. 20 is a conceptual view illustrating hollow hole 246 of a dual-axis inclined type in accordance with another embodiment. FIG. 21 is a conceptual view illustrating a crankshaft having the hollow hole 246 of FIG. 20, viewed upward from a bottom. This embodiment is different from the previous embodiment of FIGS. 1 to 19 in that the hollow hole 246 is a dual-axis inclined type.

The hollow hole 246 of the dual-axis inclined type may be formed in a lower inner side of crankshaft 240. The hollow hole 246 may be formed in a cylindrical shape, for example, inclined at a preset or predetermined angle with respect to a perpendicular center line of main journal 241. The hollow hole 246 may have a cross-section in an elliptical shape, for example, when cut in a radial direction perpendicular to an axial direction of the main journal 241.

The hollow hole 246 may be inclined in two directions with respect to the perpendicular center line. Assuming that the perpendicular center line is a Z-axis direction, the two directions may be an X-axis direction (frontward and rearward direction) and a Y-axis direction (leftward and rightward direction). The X-axis, Y-axis and Z-axis may extend perpendicular to one another. The X-axis may extend in the frontward and rearward direction, the Y-axis may extend in the leftward and rightward direction, and the Z-axis may extend in the vertical direction or the axial direction.

For example, the hollow hole 246 may be inclined in two directions, namely, the X-axis direction and the Y-axis direction, which are perpendicular to each other based on the perpendicular center line (Z-axis). That is, the hollow hole 246 may be inclined at a preset or predetermined first angle $\alpha$ when projected on a YZ plane in the X-axis direction, while inclined at a preset or predetermined second angle $\beta$ when projected on an XZ plane in the Y-axis direction.

The hollow hole 246 may have the cross-section in the elliptical shape in the radial direction. The hollow hole 246 may be eccentric to one side from the center of the main journal 241. For example, when viewing a lower end portion or end of the main journal 241 from the bottom of the crankshaft 240 in the axial direction, the hollow hole 246 may be eccentric toward the protrusion 144.

A major axis a of the hollow hole 246 passing through two focal points of an ellipse and a minor axis b of the hollow hole 246 perpendicular to the major axis a may extend respectively in directions intersecting with a first radial center line (XX' axis line, frontward and rearward direction) passing through the central portion of the protrusion 144 in the radial direction, and a second radial center line (YY' axis line, leftward and rightward direction) passing through both end portions of the balance weight 145 in the radial direction.

A center of a lower end portion or end of the hollow hole 246 may be eccentric from the center of the main journal 241 toward the center of the protrusion 144.

As other components are the same as or similar to those in the embodiment of FIGS. 1 to 19, repetitive description has been omitted.

Figure 22:
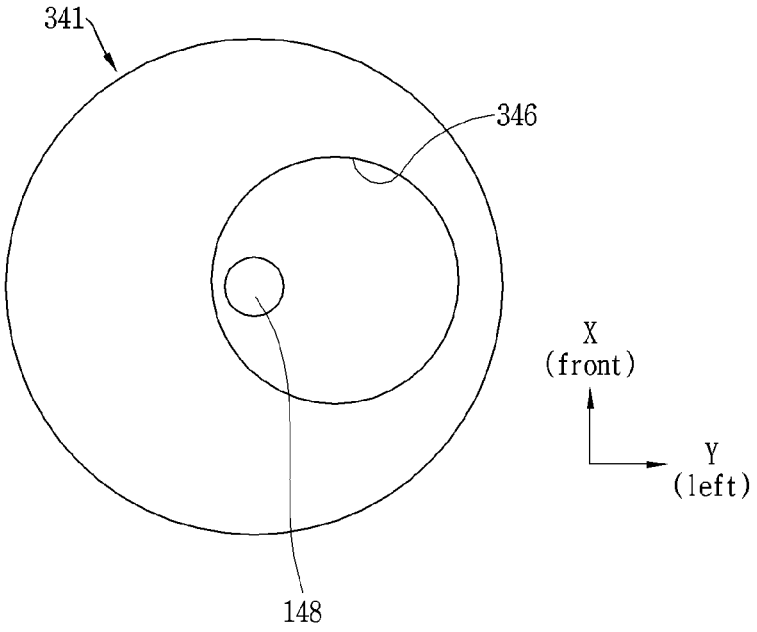
FIG. 22 is a conceptual view illustrating a crankshaft having a hollow hole of a vertical type in accordance with another embodiment, viewed upward from a bottom.

FIG. 22 is a conceptual view illustrating crankshaft 340 having hollow hole 346 of a vertical type in accordance with another embodiment, viewed upward from a bottom. The hollow hole 346 may extend in an axial direction of main journal 341. The hollow hole 346 may be formed in a cylindrical shape. The hollow hole 346 may be perpendicularly disposed in the axial direction. The hollow hole 346 may have a cross-section in a circular shape, for example.

The hollow hole 346 may be eccentric from a center of the main journal 341 in one direction. A center of the hollow hole 346 may be radially spaced apart from the center of the main journal 341.

As other components are the same as or similar to those in the embodiment of FIGS. 1 to 21, repetitive description has been omitted.

Hereinafter, a movement path of oil in crankshaft 140 and operation of oil passage will be described.

Oil may circulate in the following order. Oil→Lower region (sump) of shell 100→Oil pump 160 (impeller 167)→Crankshaft 140 (oil passage)→Upper region of shell 100→Compression unit 120→Motor unit 110→Lower region of shell 100

Oil stored in the lower region (sump) of the shell 100 may be pumped by the oil pump 160. In the oil pump 160, the oil flowing into the pump body 161 through the inlet 162 may be rotated inside the pump body 161 by the impeller 167 and moved upward by centrifugal force. The oil may flow from the pump body 161 into the crankshaft 140 through the outlet 163.

The oil in the crankshaft 140 may be supplied to the upper region of the shell 100, the compression unit 120, and the motor unit 110 through two or three movement paths.

A first oil movement path of the crankshaft 140 may be constructed as follows: Oil→Hollow hole 146→Intermediate hole 148→Upper hole 149→Upper region of shell 100

Some of the oil pumped by the oil pump 160 may move upward from the hollow hole 146 to the intermediate hole 148 in the crankshaft 140. The oil may move upward from the intermediate hole 148 into the upper hole 149. The oil may then be sprayed upward from the upper hole 149 into the upper space of the shell 100.

The oil may be sprayed on an inner uppermost surface of the cover shell 105, and deflected downward by the uppermost surface of the cover shell 105, so as to be moved from the upper region of the cover shell 105 down to the lower region of the shell 100 via the compression unit 120 and the motor unit 110.

A second oil movement path of the crankshaft 140 may be constructed as follows: Oil→Hollow hole 146→Lower communication hole 147→Outer circumferential passage groove 151→Upper communication hole 150→Eccentric shaft connection hole 152→First eccentric shaft header 153→Eccentric shaft radial hole 154→Compression unit 120

Some of the oil pumped by the oil pump 160 may flow from the hollow hole 146 in the crankshaft 140 to the lower communication hole 147. A flowing direction of the oil may change from the vertical direction of the hollow hole 146 to the radial direction of the lower communication hole 147.

The oil may move upward from the first recess 1471 of the lower communication hole 147 along the outer circumferential passage groove 151 of the main journal 141 in the spiral direction. The oil may move along the upper communication hole 150 in the second recess 1501 of the upper communication hole 150 formed in the upper end of the outer circumferential passage groove 151. The flowing direction of the oil may change from the spiral direction of the outer circumferential passage groove 151 to the radial direction of the lower communication hole 150.

The oil may flow from the upper communication hole 150 into the eccentric shaft connection hole 152. The oil may flow upward along the eccentric shaft connection hole 152 to be introduced into the first eccentric shaft header 153.

The oil may then flow from the first eccentric shaft header 153 into the eccentric shaft radial hole 154. At this time, the flowing direction of the oil may change from the vertical direction of the first eccentric shaft header 153 to the radial direction of the eccentric shaft radial hole 154.

The oil may flow to the friction surface between the eccentric shaft 142 and the connecting rod 131 through the eccentric shaft radial hole 154. That is, the oil may be introduced into the space between the outer circumferential surface of the eccentric shaft 142 and the inner circumferential surface of the eccentric shaft coupling portion 1311 of the connecting rod 131 through the eccentric shaft radial hole 154, thereby lubricating the friction surface between the eccentric shaft 142 and the connecting rod 131.

In addition, an oil passage may be provided inside the connecting rod 131. One or a first side or end of the oil passage of the connecting rod 131 may communicate with the inner space of the eccentric shaft coupling portion 1311, and another or a second side or end of the oil passage of the connecting rod 131 may communicate with an inner space of the piston coupling portion 1312. Oil may move along the oil passage of the connecting rod 131. The oil may be supplied to a friction surface with the piston 126 through the oil passage of the connecting rod 131.

The compression unit 120 may include a piston oil passage formed in the piston 126 to communicate with the oil passage of the connecting rod 131. Oil may be transferred to the compression unit 120 through the connecting rod 131, so as to lubricate a friction surface between the connecting rod 131 and the piston 126 and a friction surface between the piston 126 and the cylinder 125.

A third oil movement path of the crankshaft 140 may be formed as follows: Oil→Hollow hole 146→Lower communication hole 147→Outer circumferential passage groove 151→Upper communication hole 150→Eccentric shaft connection hole 152→First eccentric shaft header 153→Second eccentric shaft Header 155→Eccentric shaft spray hole 156→Upper region of shell 100

The third oil movement path is different from the second oil movement path in view of the path after the first eccentric shaft header 153. Therefore, repetitive description has been omitted, and only the path after the first eccentric shaft header 153 will be described.

Oil may then flow from the first eccentric shaft header 153 into the second eccentric shaft header 155. The oil may be sprayed from the second eccentric shaft header 155 to the upper region of the shell 100 through the eccentric shaft spray hole 156. The flowing direction of the oil may change from the vertical direction of the second eccentric shaft header 155 to the radial direction of the eccentric shaft spray hole 156.

The oil may be sprayed into the upper space of the shell 100 in the radial direction through the eccentric shaft spray hole 156. As the eccentric shaft 142 performs an orbital motion around the center of the crankshaft 140, the oil may be sprayed in the radial direction through the eccentric shaft spray hole 156.

The oil may be sprayed into the upper space of the shell 100 through the first to third oil movement paths or may move to the compression unit 120 to lubricate friction surfaces among the mechanical parts or components inside the compressor. In addition, as the oil sprayed into the upper space of the shell 100 is brought into contact with the motor unit 110 while passing through the motor unit 110 by gravity, heat generated from the motor unit 110 may be cooled. Also, the oil passing through the motor unit 110 may circulate to the lower region of the shell 100.

Hereinafter, operation of the oil passage of the crankshaft 140 will be described.

As the oil pump 160 pumps oil using centrifugal force, a head of the oil (fluid) (height given by the pump to the oil) may be determined according to a magnitude of the centrifugal force. Main factors affecting the head of the oil may be radius and angular velocity of the crankshaft 140. The head of the oil may be proportional to a square of an angular velocity of the crankshaft 140, and the head of the oil may be proportional to the square of a radius of the crankshaft 140.

The angular velocity of the crankshaft 140 may vary depending on an operating condition of the compressor. That is, the compressor may operate at high or low speed. The oil pump 160 using centrifugal force does not have a problem in a high-speed operation, but may cause a problem in a low-speed operation. In order to overcome this, the oil pump 160 using the centrifugal force needs to sufficiently secure the head of the oil even in the low-speed operation.

As described above, the radius of the crankshaft 140 must increase in order to sufficiently secure the head of the oil. However, when the radius of the crankshaft 140 increases, another problem occurs in that a weight of the compressor increases. Accordingly, there is a need for a method for increasing the head of the oil without increasing the radius of the crankshaft 140.

Embodiments disclosed herein provide an oil passage of the crankshaft 140 capable of improving an oil supply amount while securing the head of oil even under an adverse condition of a low-speed operation without increasing the radius of the crankshaft 140. In order to improve an oil supply amount, the hollow hole 146 may be provided inside the crankshaft 140.

The hollow hole 146 may be located in a lowermost part or portion of the oil passage of the crankshaft 140. The diameter of the hollow hole 146 may be larger than the diameters of the intermediate hole 148 and the upper hole 149.

If the holes are arranged in order of size (diameter), the diameter may decrease in the order of the hollow hole 146, the intermediate hole 148, and the upper hole 149. The oil passage may have a cross-sectional area that decreases in the order of the hollow hole 146, the intermediate hole 148, and the upper hole 149, which sequentially decrease in height.

Assuming that an oil flow rate is constant, as an amount of flowing oil is proportional to the cross-sectional area of the oil passage, the amount of flowing oil may decrease in the order of the hollow hole 146, the intermediate hole 148, and the upper hole 149. Assuming that an amount of flowing oil is constant, as the oil flow rate is inversely proportional to the cross-sectional area of the oil passage, the oil flow rate may increase in the order of the hollow hole 146, the intermediate hole 148, and the upper hole 149.

The oil pumped by the oil pump 160 may be introduced into the hollow hole 146 formed in the lowermost end portion of the crankshaft 140. The hollow hole 146 may receive pumping pressure (dynamic pressure) from the oil pump 160. The shape and structure of the hollow hole 146 may affect the dynamic pressure of oil. In order to improve oil supply performance, the dynamic pressure of oil may be increased by changing the shape and structure of the hollow hole 146.

The dynamic pressure of oil may be proportional to $(V^2 \times r^2)/\cos(\theta)$, where V denotes a rotational speed of the crankshaft 140, r denotes a rotation radius of the hollow hole 146, and θ denotes an inclination angle. In order to increase the dynamic pressure of oil, the hollow hole 146 may be configured as the inclined hole 1461 or the eccentric vertical hole 1462, or a combination of the inclined hole 1461 and the vertical hole 1462 (see FIGS. 1 to 19).

The inclined hole 1461 may be inclined in two directions (X-axis and Y-axis) with respect to the axial direction (Z-axis). The axial direction may indicate the axial direction of the crankshaft 140. The X-axis and Y-axis directions may be perpendicular to the axial direction (Z-axis), and may also be perpendicular to each other.

The structure that the inclined hole 1461 is inclined in the X-axis direction with respect to the Z-axis may indicate that the inclined hole 1461 is inclined at a preset or predetermined inclination angle α with respect to the Z-axis when projecting the inclined hole 461 on the YZ plane in the X-axis direction (see FIG. 16). The structure that the inclined hole 1461 is inclined in the Y-axis direction with respect to the Z-axis may indicate that the inclined hole 1461 is inclined at a preset or predetermined inclination angle β with respect to the Z-axis when projecting the inclined hole 1461 on the XZ plane in the Y-axis direction.

The inclined hole 1461 may be formed such that the inclination angle α inclined in the X-axis direction with respect to the Z-axis and the inclination angle β inclined in the Y-axis direction with respect to the Z-axis are different from each other. The vertical hole 1462 may extend vertically along the axial direction (Z-axis), and the center of the vertical hole 1462 may be spaced radially outward from the center of the crankshaft 140 by a preset or predetermined distance. The vertical hole 1462 may be disposed eccentrically inside the crankshaft 140.

The dynamic pressure of the oil in the hollow hole 146 may be proportional to the square of the rotation radius r.

Figure 23:
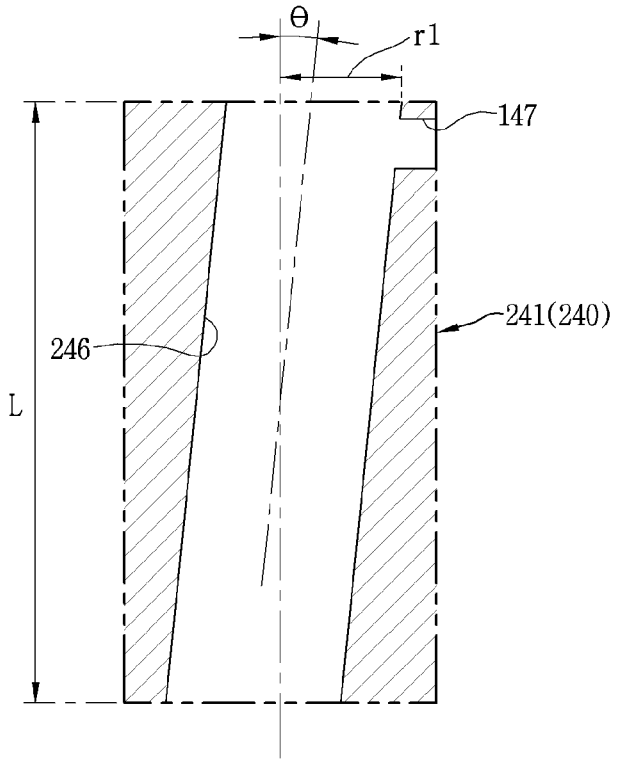
FIG. 23 is a conceptual view illustrating an effect of increasing a rotational radius of the hollow hole of the dual-axis inclined type.
Figure 24:
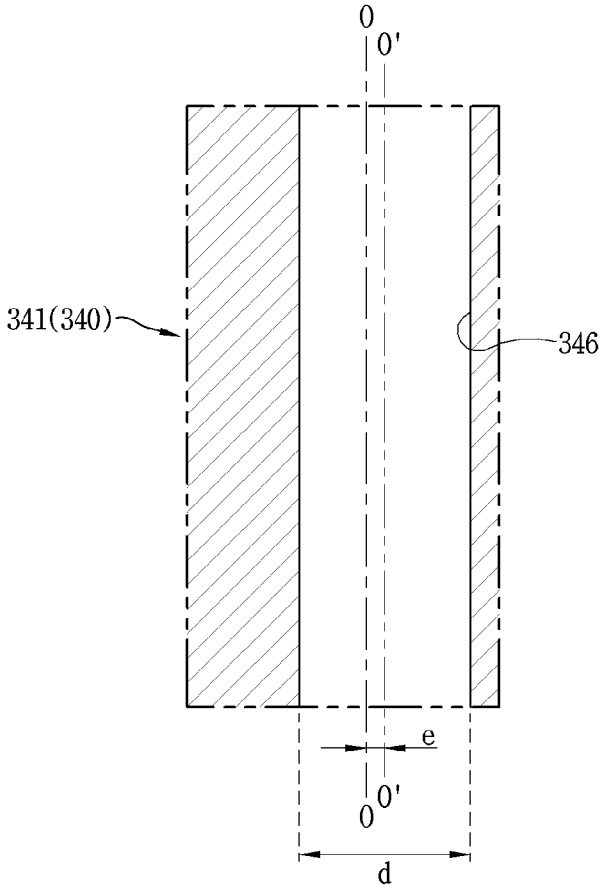
FIG. 24 is a conceptual view illustrating an effect of increasing a rotational radius of the hollow hole of the vertical type.
Figure 25:
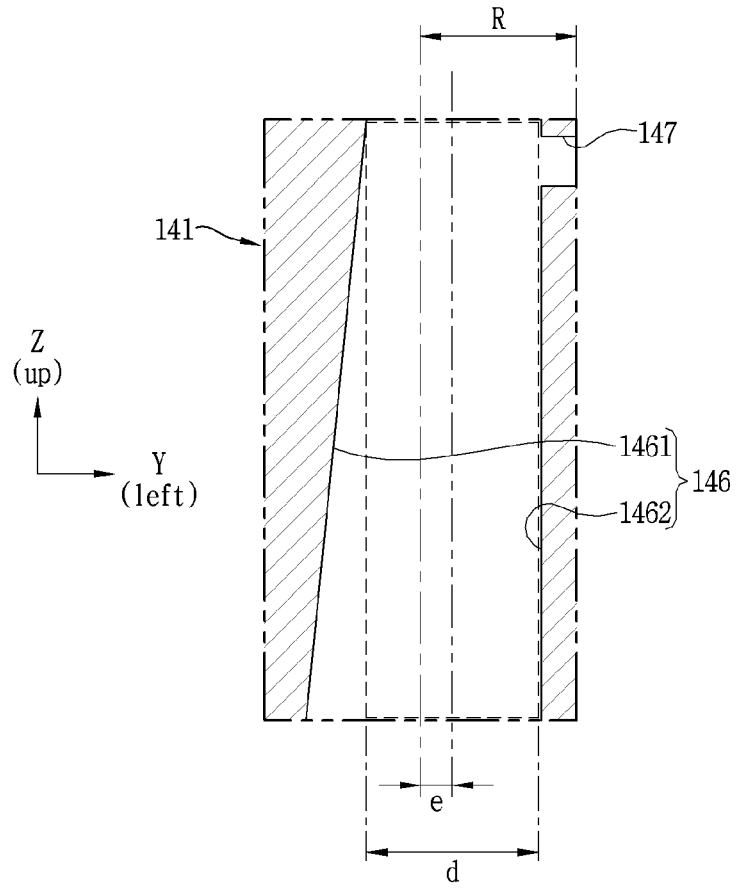
FIG. 25 is a conceptual view illustrating an effect of increasing a rotational radius of a hollow hole of a dual-axis inclined and vertical type.

FIG. 23 is a conceptual view illustrating an effect of increasing a rotational radius of a hollow hole 246 of a dual-axis inclined type. FIG. 24 is a conceptual view illustrating an effect of increasing a rotational radius of a hollow hole 346 of a vertical type. FIG. 25 is a conceptual view illustrating an effect of increasing the rotational radius of the hollow hole 146 of the dual-axis inclined and vertical type.

A general vertical type hollow hole is disposed inside a crankshaft in a manner that the center of the hollow hole is aligned with the center of the crankshaft. The term "center of the crankshaft" refers to the center of a main journal.

The rotational radius r0 of the general vertical type hollow hole is d/2, where d denotes a diameter of the hollow hole.

A hollow hole 246 of a dual-axis inclined type according to an embodiment may be formed such that a diameter thereof is smaller than an outer diameter of crankshaft 240, more specifically, an outer diameter of main journal 241. The hollow hole 246 may have an inclination angle greater than 0 degree and less than 20 degrees.

Referring to FIG. 23, a rotational radius r1 of the hollow hole 246 of the dual-axis inclined type may be L×tan (θ), where L denotes a length of the hollow hole 246 in the axial direction, and 8 denotes an inclination angle of the hollow hole 146.

The dual-axis inclined type hollow hole 246 may improve dynamic pressure of oil compared to the general vertical type hollow hole while maintaining basic rigidity of the crankshaft 240. More specifically, in the case of a crankshaft to which the general vertical type hollow hole is applied, a thickness ((D−d)/2) of the crankshaft may be kept constant along an axial direction.

For this reason, if the diameter of the hollow hole increases to improve the dynamic pressure of oil, the rigidity of the crankshaft decreases. On the other hand, if the diameter of the hollow hole decreases to improve the rigidity of the crankshaft, the dynamic pressure of the oil decreases. Therefore, the general vertical type hollow hole has a limitation in increasing the dynamic pressure of oil while maintaining the basic rigidity of the crankshaft.

On the other hand, in the case of the crankshaft 240 to which the dual-axis inclined type hollow hole 246 according to embodiments is applied, the hollow hole 246 may be inclined in the two directions with respect to the axial direction, and the center of the hollow hole 246 may be eccentric from the center of the crankshaft 240 in the radial direction. The hollow hole 246 may have an elliptical cross-sectional shape, and may be asymmetric with respect to a radial center line passing through the center of the crankshaft 240 in the radial direction. According to this embodiment, a width (thickness) of a radial cross-section of the crankshaft 240 in which the hollow hole 246 is formed may change along the circumferential direction of the crankshaft 140.

A radial thickness between the inner circumferential surface and the outer circumferential surface of the crankshaft 240 arranged to be eccentric toward a radially outermost side from the center of the crankshaft 240 having the hollow hole 246 may be the smallest, but a radial thickness between the inner and outer circumferential surfaces of the crankshaft 140 at an opposite side in the radial direction may be the greatest. Therefore, a maximum radial thickness of the crankshaft 240 may reinforce the rigidity of the crankshaft 240 with respect to a minimum radial thickness.

The crankshaft 240 according to embodiments may be formed such that a side wall portion or wall with a greater radial thickness reinforces rigidity of an opposite side wall portion or wall with a smaller radial thickness. This thickness-reinforcing structure of the crankshaft 240 may be maintained along the circumferential direction. In addition, the center of the hollow hole 246 may change along the axial direction of the crankshaft 240, but the thickness-reinforcing structure of the crankshaft 240 described above may be maintained.

The crankshaft 240 according to embodiments disclosed herein may be formed such that the center of the hollow hole 246 is eccentric outward from the center of the crankshaft 240 in the radial direction, thereby maximizing the rotational radius r1 of the hollow hole 246. This may result in securing the rigidity for the radial thickness of the crankshaft 240 and simultaneously increasing the dynamic pressure of oil filled in the hollow hole 246. This is because the rotational radius r1 of the hollow hole 246 of the dual-axis inclined type may be made larger than the rotational radius r0 of the general vertical type hollow hole, by virtue of the eccentric structure of the hollow hole 246.

Referring to FIG. 24, a rotational radius r2 of vertical type hollow hole 346 may be (d/2)+e, where d denotes a diameter of the hollow hole 346, and e denotes a center distance of the hollow hole 346. The vertical type hollow hole 346 may extend vertically along the axial direction (Z-axis), and the center of the hollow hole 346 may be spaced radially outward from the center of the crankshaft 340. A center distance of the hollow hole 346 may be a radial distance between a center of crankshaft 340 and the center of the hollow hole 346.

The crankshaft 340 to which the eccentric vertical type hollow hole 346 according to embodiments is applied may be formed such that a side wall portion or wall with a greater radial thickness reinforces rigidity of an opposite side wall portion or wall with a smaller radial thickness. In addition, a rotational radius r2 of the eccentric vertical type hollow hole 346 may be further increased by e (the center distance of the hollow hole 346) than the rotational radius d/2 of the general vertical type hollow hole. Therefore, the crankshaft 340 to which the eccentric vertical type hollow hole 346 is applied may increase dynamic pressure of oil.

Referring to FIG. 25, a rotational radius r3 of the hollow hole 146 in which the dual-axis inclined hole 1461 and the vertical hole 1462 are combined may be max(L×tan(θ), (d/2)+e)), where Max denotes a relatively larger value of two values in parentheses, d denotes a diameter of the hollow hole 146, e denotes a center distance of the hollow hole 146, and θ denotes an inclination angle of the hollow hole 146.

The rotational radius r3 of the dual-axis inclined and vertical type hollow hole 146 may be determined to be the larger value of the two rotational radius values. Therefore, the crankshaft 140 to which the hollow hole 146 formed by the combination of the eccentric dual-axis inclined hole 1461 and the eccentric vertical hole 1462 is applied, as aforementioned, may simultaneously obtain improved rigidity for the thickness of the crankshaft 140 and increased dynamic pressure of oil, thereby enhancing oil supply performance.

Figure 26:
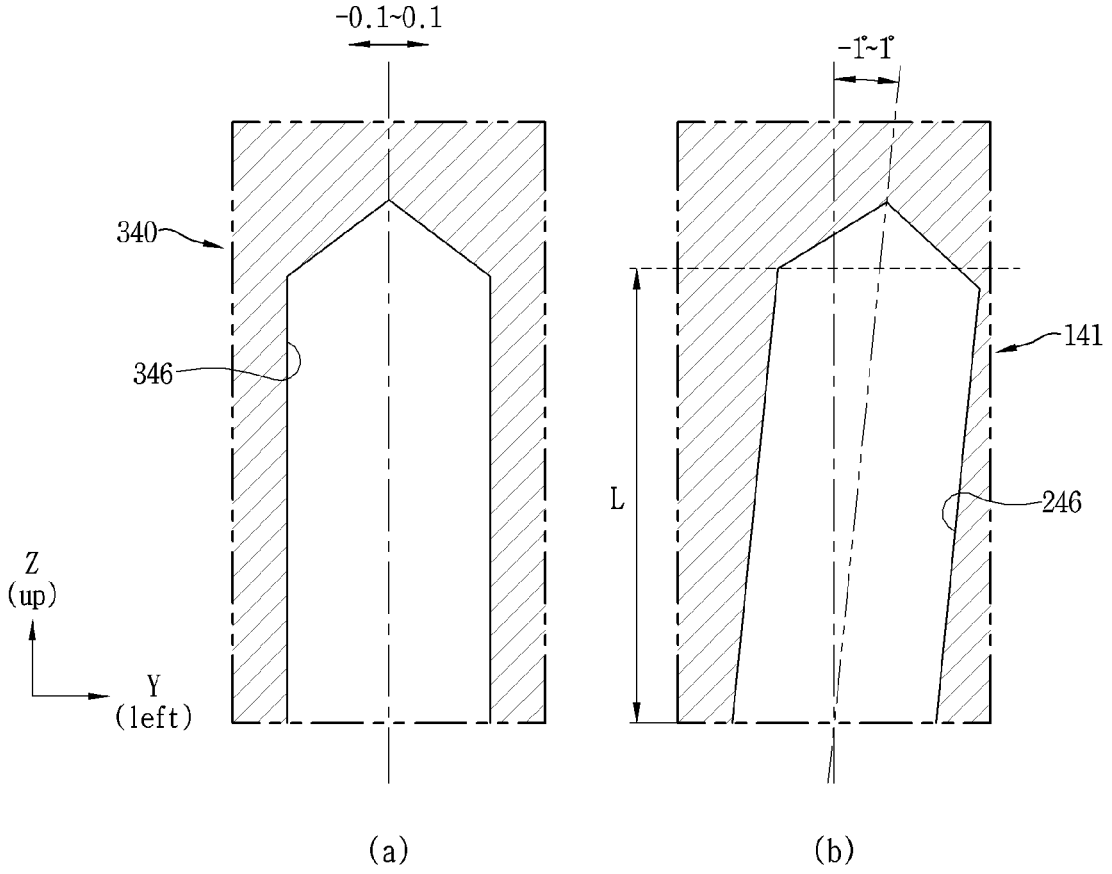
FIG. 26 is a conceptual view illustrating comparison results of distribution in a horizontal direction (X-axis direction) of the vertical type hollow hole and the inclined type hollow hole in accordance with embodiments.

FIG. 26 is a conceptual view illustrating comparison results of distribution in a horizontal direction (X-axis direction) of the vertical type hollow hole 346 and the inclined type hollow hole 146 in accordance with embodiments.

The vertical type hollow hole 346 according to embodiments may be arranged to be eccentric in the horizontal direction (X-axis direction or Y-axis direction) from the center of the crankshaft 340 (that is, its center being eccentric to one side). For example, the center distance of the eccentric vertical type hollow hole 346 may be −0.1 to 0.1 mm (see (a) of FIG. 26). The rotational radius of the eccentric vertical-type hollow hole 346 may be (d/2)+0.2 mm.

The inclined type hollow hole 246 according to embodiments may be inclined at a preset or predetermined inclination angle with respect to the Z-axis. For example, the preset or predetermined inclination angle may be −1° to 1° (see (b) of FIG. 26). Assuming that L (height of the hollow hole 146) is 20 mm, a rotational radius 20*tan (2°) of the inclined type hollow hole 246 may be (d/2)+0.7 mm. Therefore, in order to increase the rotational radius of the hollow hole 146, 246, it may be more effective to incline the inclined type hollow hole 146 by 2° rather than moving a horizontal center of the vertical type hollow hole 346 by 2 mm.

Figure 27:
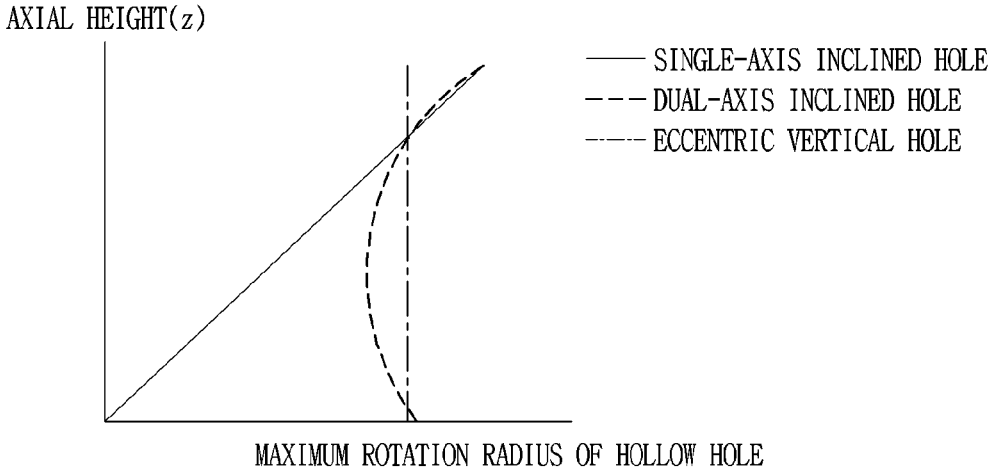
FIG. 27 is a graph comparing a maximum rotational radius of a hollow hole according to a height in an axial direction, for each of a hollow hole of a dual-axis inclined type, a hollow hole of a single-axis inclined type, and a hollow hole of an eccentric vertical type in accordance with embodiments.

FIG. 27 is a graph comparing a maximum rotational radius of a hollow hole according to a height in an axial direction, for each of the hollow hole 246 of the dual-axis inclined type, a hollow hole of a single-axis inclined type, and the hollow hole 346 of the eccentric vertical type in accordance with embodiments. A hollow hole of a single-axis inclined type may be inclined in a single direction, namely, the X-axis direction or the Y-axis direction with respective to the Z-axis.

Referring to FIG. 27, in the case of the hollow hole of the single-axis inclined type, the maximum rotational radius of the hollow hole may increase in proportion to the height in the axial direction. In the case of the hollow hole 346 of the eccentric vertical-type, the maximum rotational radius of the hollow hole 346 may be constant along the axial height. In the case of the hollow hole 246 of the dual-axis inclined type, the maximum rotational radius of the hollow hole 246 slightly decreases and then increases as the height in the axial direction increases, but an increase or decrease of the rotational radius is very small. Therefore, it is safe to say that the maximum rotational radius of the hollow hole 246 is almost constant according to the height in the axial direction.

Figure 28:
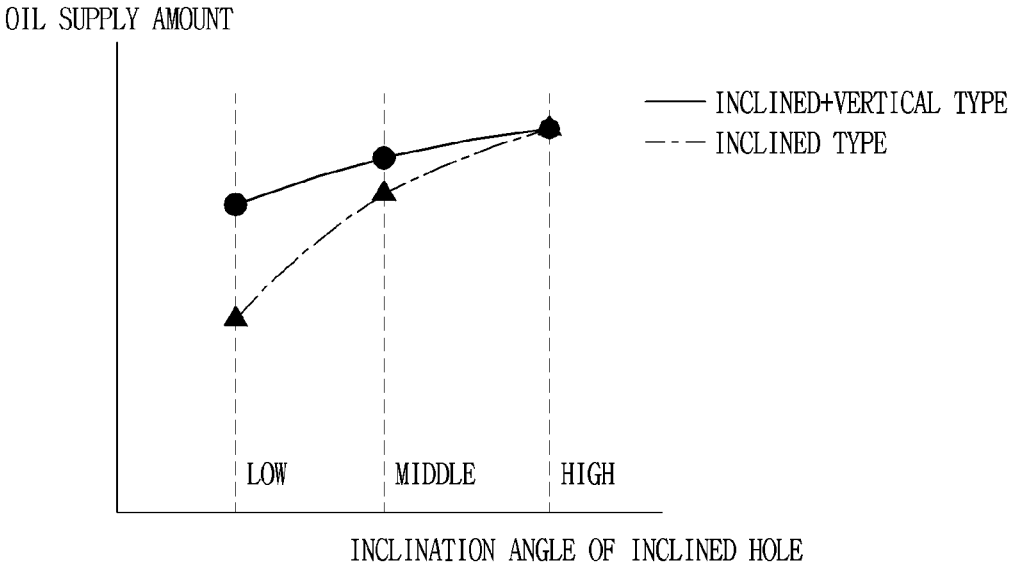
FIG. 28 is a graph comparing an increase rate of an oil supply amount according to an inclination angle of an inclined hole for each of a hollow hole in which the dual axis inclined type and the vertical type are combined, and a hollow hole of an inclined type in accordance with embodiments.

FIG. 28 is a graph comparing an increase rate of an oil supply amount according to the inclination angle of the inclined hole 1461 for each of the hollow hole 146 of the dual-axis inclined and vertical type and the hollow hole 146 of the inclined type in accordance with embodiments.

Referring to FIG. 28, the crankshaft 140 to which the hollow hole 146 of the dual-axis inclined and vertical type is applied may have a larger oil supply amount than the crankshaft 140 to which the hollow hole 146 of the inclined type is applied. However, an increase in an oil supply amount according to an increase in the inclination angle of the inclined hole 1461 may be relatively less in the crankshaft 140 to which the hollow hole 146 of the inclined type is applied than in the crankshaft 140 to which the hollow hole 146 in combination of the dual-axis inclined type and the vertical type is applied.

As such, according to embodiments, the hollow hole 146 may be provided in the crankshaft 140. The hollow hole 146 may be inclined in two directions perpendicular to the axial direction of the crankshaft 140 (hereinafter, a dual-axis inclined type). The hollow hole 146 may be formed vertically in the axial direction of the crankshaft 140 (hereinafter, a vertical type). The hollow hole 146 may be formed by combining the dual-axis inclined type and the vertical type. The center of the hollow hole 146 may be arranged to be eccentric outward from the center of the crankshaft 140 in the radial direction.

According to this embodiment, as the rotational radius of the hollow hole 146 increases, the dynamic pressure of oil for pumping the oil may be maximized, thereby greatly increasing the oil supply amount. The oil pump 160 which is disposed on the lower end portion of the crankshaft 140 may be implemented as a centrifugal pump requiring an inexpensive cost and having a simple structure. It may also greatly contribute to reducing manufacturing costs of the compressor. Even when the compressor operates at a low speed, the decrease in dynamic pressure of the oil pump 160 may be minimized, thereby enhancing lubrication performance and cooling performance of the oil. In addition, the simple structure of the hollow hole may facilitate formation of the hollow hole.

Embodiments disclosed herein provide a hermetic compressor having a structure that can solve the above problems.

Embodiments disclosed herein provide a hermetic compressor having a structure in which oil supply performance is improved by increasing dynamic pressure of oil. Embodiments disclosed herein further provide a hermetic compressor having a structure in which shaft rigidity is improved by increasing a thickness of a crankshaft. Embodiments disclosed herein also provide a hermetic compressor having a structure that can greatly contribute to cost reduction by applying an oil centrifugal pump to a lower end portion of a crankshaft.

Embodiments disclosed herein provide a hermetic compressor having a structure capable of performing a low-speed operation even by employing a centrifugal oil pump, which is inexpensive, instead of a viscous oil pump. Embodiments disclosed herein also provide a hermetic compressor having a structure that is easy to be formed by simplifying an oil passage structure of a crankshaft.

Embodiments disclosed herein provide a hermetic compressor having a structure capable of simplifying a structure of a member for achieving the above aspects. Embodiments disclosed herein additionally provide a compressor having a structure capable of being applied to different types of compressors while achieving the aspects.

A hermetic compressor according to an embodiment may include a frame, a crankshaft, and an oil pump. The frame may be disposed inside a shell. The crankshaft may be provided with a hollow hole therein, and rotatably mounted to the frame.

The oil pump may be mounted to a lower portion of the crankshaft. An impeller may be disposed inside the oil pump to be rotatable together with the crankshaft. One or a first side of the impeller may be immersed in oil stored in a lower region of the shell, and another or a second side of the impeller may communicate with the hollow hole. The oil pump may pump the oil stored in the lower region of the shell into the hollow hole using centrifugal force.

The hollow hole may be provided with an inclined hole inclined in two directions with respect to an axial direction of the crankshaft. According to this embodiment, the inclined hole may increase a rotational radius of the oil pumped into the hollow hole so as to increase dynamic pressure of the oil, thereby increasing an oil supply amount and improving oil supply performance.

The inclined hole may be inclined in a first direction and a second direction with respect to the axial direction. The first direction may have an inclination angle smaller than 90 degrees between the axial direction and an X-axis direction perpendicular to the axial direction, and the second direction may have an inclination angle smaller than 90 degrees between the axial direction and a Y-axis direction perpendicular to the axial direction. According to this embodiment, as a height of the hollow hole in the axial direction increases, a maximum rotational radius of the hollow hole may be maintained almost constantly.

According to one embodiment, the crankshaft may include a lower communication hole that extends outward from an upper end portion of the hollow hole in a radial direction of the crankshaft, and an outer circumferential passage groove that extends from an outside of the lower communication hole spirally along a circumferential surface of the crankshaft. The inclined hole may have preset or predetermined inclination angles in a first direction and a second direction, respectively. The first direction may be a direction toward the lower communication hole perpendicular to the axial direction. The second direction may be a direction forming a right angle with respect to the first direction along a circumferential direction. According to this embodiment, the hollow hole may be inclined toward the lower communication hole and the lower communication hole may extend in the radial direction of the crankshaft, so that the dynamic pressure of the oil may be further increased by the centrifugal force and the oil supply amount may be increased.

The inclined hole may have a cross-section in an elliptical shape in the radial direction. The cross-section of the inclined hole may be eccentric outward in the radial direction from an axial center line passing through a center of the crankshaft in the axial direction. According to this embodiment, the hollow hole may be eccentric from the center of the crankshaft. A radial thickness of the crankshaft between inner and outer circumferential surfaces of the crankshaft may change along the circumferential direction, and a radial thickness of the crankshaft at an opposite side to a direction in which the hollow hole is eccentric may be thick. Therefore, a thick side wall portion may reinforce rigidity of an opposite thin side wall portion.

The crankshaft may include an intermediate hole that extends upward from an upper end or end portion of the hollow hole, and an upper hole that extends upward from the intermediate hole. The hollow hole may have a cross-sectional area that is larger than a cross-sectional area of the intermediate hole and smaller than an outer diameter of the crankshaft. According to this embodiment, an oil pump configured as an inexpensive centrifugal pump may be mounted to the lower end portion of the crankshaft, thereby reducing manufacturing costs.

The inclined hole may have a cross-sectional area constantly maintained from a bottom to a top along the axial direction.

The hollow hole may have a cross-sectional area that decreases from a bottom to a top along the axial direction. According to this embodiment, as the cross-sectional area of the hollow hole decreases from the bottom to the top in the axial direction, a flow rate of oil may increase, which may allow a low-speed operation even by applying the oil pump configured as the centrifugal pump other than a general viscous type oil pump.

The hollow hole may further include a vertical hole that extends along the axial direction of the crankshaft and disposed to be eccentric from the center of the crankshaft in the radial direction. According to the embodiment, the hollow hole may be easily formed by virtue of its simple structure.

The vertical hole may have a circular cross-sectional shape, and a distance between a center of the vertical hole and a center of the crankshaft may be constantly maintained along the axial direction of the crankshaft. In this embodiment, the inclined hole may have a cross-section in an elliptical shape in the radial direction of the crankshaft, the cross-section of the vertical hole may have a circular shape in the radial direction of the crankshaft, and at least partial regions of the cross-sections of the inclined hole and the vertical hole may overlap each other in the radial direction. According to this embodiment, an amount of flowing oil may be secured.

The inclined hole may extend in a diagonal direction between the axial direction and the radial direction of the crankshaft. The vertical hole may communicate with an upstream side of the inclined hole based on a flowing direction of the oil and the vertical hole may be formed asymmetrically in the radial direction based on an axial center line passing through the center of the crankshaft in the axial direction.

The crankshaft may include a lower communication hole that extends outward from an upper end portion or end of the hollow hole in a radial direction of the crankshaft, and an outer circumferential passage groove that extends from an outside of the lower communication hole spirally along an outer circumferential surface of the crankshaft. The vertical hole may be eccentric from the center of the crankshaft toward the lower communication hole. The vertical hole may be formed such that a center thereof is eccentric from the center of the crankshaft by a distance smaller than a radius of the crankshaft.

The hermetic compressor may further include a motor unit disposed below the frame and including a rotor that rotates the crankshaft, and a compression unit disposed above the frame and including a piston that performs a reciprocating motion in a cylinder by receiving a drive force through a connecting rod connected to the crankshaft, and configured to compress refrigerant suctioned into the cylinder.

A hermetic compressor according to another embodiment is provided that may include a shell, a frame elastically supported inside the shell in a vertical direction, a crankshaft having a hollow hole therein and rotatably mounted to the frame, and a motor unit disposed below the frame and including a rotor that rotates the crankshaft, a compression unit disposed above the frame and including a piston that performs a reciprocating motion in a cylinder by receiving a drive force through a connecting rod connected to the crankshaft, so as to compress refrigerant suctioned in the cylinder, and an oil pump mounted to a lower portion of the crankshaft to be rotatable with the crankshaft, and having one or a first side immersed in oil stored in a lower region of the shell and another or a second side that communicates with the hollow hole, so as to pump the oil from the one side to the another side using centrifugal force. The hollow hole may include an inclined hole inclined in two directions with respect to an axial direction of the crankshaft, and a vertical hole that extends along the axial direction of the crankshaft and eccentric radially from a center of the crankshaft, to apply dynamic force for scattering the oil to an upper region of the shell.

According to this embodiment, the dual-axis inclined hole and the eccentric vertical hole may have a simple structure and a radial thickness of the crankshaft may increase so as to improve rigidity of the shaft. In addition, dynamic pressure and an oil supply amount may increase. This may allow a centrifugal pump to be applied, thereby enabling a low-speed operation.

A hermetic compressor according to still another embodiment is provided that may include a shell, a frame elastically supported inside the shell in a vertical direction, a crankshaft having a hollow hole therein and rotatably mounted to the frame, and a motor unit disposed below the frame and including a rotor that rotates the crankshaft, a compression unit disposed above the frame, and including a piston that performs a reciprocating motion in a cylinder by receiving a drive force through a connecting rod connected to the crankshaft, so as to compress refrigerant suctioned in the cylinder, and an oil pump mounted to a lower portion of the crankshaft to be rotatable with the crankshaft, and having one or a first side immersed in oil stored in a lower region of the shell and another or a second side that communicates with the hollow hole, so as to pump the oil from the one side to the another side using centrifugal force. The hollow hole may include a vertical hole that extends along the axial direction of the crankshaft and eccentric in a radial direction of the crankshaft from a center of the crankshaft, to apply dynamic force for scattering the oil to an upper region of the shell.

According to this embodiment, the vertical hole may have a simple structure and a radial thickness of the crankshaft may increase, thereby improving axial rigidity. In addition, dynamic pressure and an oil supply amount may increase. This may allow a centrifugal pump to be applied, thereby enabling a low-speed operation.

According to embodiments disclosed herein, at least the following advantages may be obtained.

A hollow hole may be provided inside a crankshaft. The hollow hole may be formed to be inclined in two directions perpendicular to an axial direction of the crankshaft (dual-axis inclined type). The hollow hole may be formed perpendicularly in the axial direction of the crankshaft (vertical type). The hollow hole may be formed by combining a dual-axis inclined type and a vertical type. A center of the hollow hole may be arranged to be eccentric outward from a center of the crankshaft in a radial direction. According to this embodiment, as a rotational radius of the hollow hole increases, dynamic pressure of oil for pumping the oil may be maximized, thereby greatly increasing an oil supply amount.

The oil pump disposed on a lower end portion of the crankshaft may be implemented as a centrifugal pump requiring a low cost and having a simple structure. It can greatly contribute to reducing manufacturing costs of the compressor. Even when the compressor operates at a low speed, the decrease in dynamic pressure of the oil pump may be minimized, thereby enhancing lubrication performance and cooling performance of the oil. In addition, the simple structure of the hollow hole may facilitate formation of the hollow hole.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hermetic compressor, comprising:

a frame disposed inside of a shell;

a crankshaft having a hollow hole therein and rotatably mounted to the frame; and an oil pump mounted to a lower portion of the crankshaft and having an impeller rotatable together with the crankshaft, wherein a first side of the impeller is immersed in oil stored in a lower region of the shell and a second side of the impeller communicates with the hollow hole such that the oil is pumped from the first side to the second side by centrifugal force, wherein the hollow hole comprises an inclined region and a vertical region that extends along an axial direction of the crankshaft and eccentric from a center of the crankshaft in a radial direction of the crankshaft, wherein a central axis of the inclined region, based on an orthogonal XYZ coordinate system having a Z-axis aligning with a rotational axis of the crankshaft, is inclined in X-axis and Y-axis directions with respect to the Z-axis on both a YZ plane and an XZ plane of the orthogonal XYZ coordinate system when the central axis of the inclined region is projected to the respective planes, and wherein the crankshaft further comprises an axial through hole formed through the crankshaft in the axial direction of the crankshaft from one end of the hollow hole.

2. The hermetic compressor of claim 1, wherein the central axis of the inclined region has an inclination angle smaller than 90 degrees between the Z-axis and the X-axis directions in the XZ plane, and wherein the central axis of the inclined region has an inclination angle smaller than 90 degrees between the Z-axis and the Y-axis directions in the YZ plane.

3. The hermetic compressor of claim 1, wherein the crankshaft further comprises:

a lower communication hole that extends outward from an upper end portion of the hollow hole in the radial direction of the crankshaft; and an outer circumferential passage groove that extends from an outside of the lower communication hole spirally along an outer circumferential surface of the crankshaft.

4. The hermetic compressor of claim 1, wherein the inclined region has a cross-section in an elliptical shape in the radial direction that is eccentric outward in the radial direction from an axial center line passing through a center of the crankshaft in the axial direction.

5. The hermetic compressor of claim 1, wherein the axial through hole comprises:

an intermediate hole that extends upward from an upper end portion of the hollow hole; and an upper hole that extends upward from the intermediate hole and communicates with an upper region of the shell to spray the oil into the upper region, and wherein the hollow hole has a cross-sectional area that is larger than a cross-sectional area of the intermediate hole and smaller than an outer diameter of the crankshaft.

6. The hermetic compressor of claim 5, wherein the upper hole is inclined with respect to an axial center line of the crankshaft and has an upper end portion eccentric and at an opposite side to an eccentric shaft, such that the oil is sprayed at an angle inclined with respect to the axial center line while the crankshaft rotates.

7. The hermetic compressor of claim 1, wherein the inclined region has a same cross-sectional area from a bottom to a top along the axial direction of the crankshaft.

8. The hermetic compressor of claim 1, wherein the hollow hole has a cross-sectional area that decreases from a bottom to a top along the axial direction of the crankshaft.

9. The hermetic compressor of claim 1, wherein axial extents of the inclined region and the vertical region circumferentially overlap one another.

10. The hermetic compressor of claim 9, wherein the vertical region has a cross-section having a circular shape, and wherein a distance between a center of the vertical region and the center of the crankshaft is the same along the axial direction of the crankshaft.

11. The hermetic compressor of claim 9, wherein the inclined region has a cross-section having an elliptical shape in the radial direction of the crankshaft, wherein the vertical region has a cross-section having a circular shape in the radial direction of the crankshaft, and wherein the inclined region and the vertical region are disposed such that at least partial regions of the cross-sections thereof in the radial direction overlap each other.

12. The hermetic compressor of claim 9, wherein the inclined region extends in a diagonal direction between the axial direction and the radial direction of the crankshaft, wherein the vertical region communicates with an upstream side of the inclined region based on a flow direction of the oil, and wherein the vertical region is formed asymmetrically in the radial direction based on an axial center line that passes through the center of the crankshaft in the axial direction.

13. The hermetic compressor of claim 9, wherein the crankshaft comprises:

a lower communication hole that extends outward from an upper end portion of the hollow hole in the radial direction; and an outer circumferential passage groove that extends from an outside of the lower communication hole spirally along an outer circumferential surface of the crankshaft, to transfer the oil into a gap between the outer circumferential surface of the crankshaft and a shaft support portion that supports the crankshaft, wherein the vertical region is eccentric from the center of the crankshaft toward the lower communication hole, and wherein the vertical region is formed such that a center thereof is eccentric from the center of the crankshaft by a distance smaller than a radius of the crankshaft.

14. The hermetic compressor of claim 1, further comprising:

a motor unit disposed below the frame, and including a rotor that rotates the crankshaft; and a compression unit disposed above the frame, and including a piston that performs a reciprocating motion in a cylinder by receiving a drive force through a connecting rod connected to the crankshaft, so as to compress a refrigerant suctioned into the cylinder.

15. The hermetic compressor of claim 14, wherein the crankshaft comprises:

a lower communication hole that extends outward from an upper end portion of the hollow hole in the radial direction;

an outer circumferential passage groove that extends from an outside of the lower communication hole to an upper side of the crankshaft spirally along an outer circumferential surface of the crankshaft;

an upper communication hole that extends inward from the outer circumferential passage groove in the radial direction of the crankshaft; and an eccentric shaft connection hole that extends from the upper communication hole toward an inside of an eccentric shaft coupled to the connecting rod;

a first eccentric shaft header formed inside of the eccentric shaft to communicate with the eccentric shaft connection hole; and an eccentric shaft radial hole that extends from the first eccentric shaft header to an outer circumferential surface of the eccentric shaft, and configured to transfer the oil to a gap between the outer circumferential surface of the eccentric shaft and an eccentric shaft coupling portion of the connecting rod.

16. The hermetic compressor of claim 15, wherein the crankshaft further comprises:

a second eccentric shaft header disposed at an upper side of the first eccentric shaft header and having a larger diameter than a diameter of the first eccentric shaft header; and an eccentric shaft spray hole that extends radially outward from the second eccentric shaft header toward the outer circumferential surface of the eccentric shaft, to spray the oil into an upper space of the shell while the eccentric shaft rotates.

17. A hermetic compressor, comprising:

a shell;

a frame elastically supported inside of the shell in a vertical direction;

a crankshaft having a hollow hole therein and rotatably mounted to the frame;

a motor unit disposed below the frame and including a rotor that rotates the crankshaft;

a compression unit disposed above the frame, and including a piston that performs a reciprocating motion in a cylinder by receiving a drive force through a connecting rod connected to the crankshaft, so as to compress a refrigerant suctioned into the cylinder; and an oil pump mounted to a lower portion of the crankshaft to be rotatable with the crankshaft, and having a first end immersed in oil stored in a lower region of the shell and a second end that communicates with the hollow hole, so as to pump the oil from the first end to the second end using centrifugal force, wherein the hollow hole comprises:

an inclined region inclined in two directions with respect to an axial direction of the crankshaft; and a vertical region that extends along the axial direction of the crankshaft and eccentric from a center of the crankshaft in a radial direction, to apply a dynamic force for scattering the oil to an upper region of the shell, wherein axial extents of the inclined region and the vertical region circumferentially overlap one another, wherein a central axis of the inclined region, based on an orthogonal XYZ coordinate system having a Z-axis aligning with a rotational axis of the crankshaft, is inclined in X-axis and Y-axis directions with respect to the Z-axis on both a YZ plane and an XZ plane of the coordinate system when the central axis of the inclined region is projected to the respective planes, and wherein the crankshaft further comprises an axial through hole formed through the crankshaft in the axial direction of the crankshaft from one end of the hollow hole.

18. The hermetic compressor of claim 17, wherein the inclined region has a cross-section having an elliptical shape in the radial direction of the crankshaft, wherein the vertical region has a cross-section having a circular shape in the radial direction of the crankshaft, and wherein the inclined region and the vertical region are disposed such that at least partial regions of the cross-sections thereof in the radial direction overlap each other.

* * * * *